US012735964B2

(12) United States Patent
Xiao et al.

(10) Patent No.: US 12,735,964 B2
(45) Date of Patent: Sep. 15, 2026

(54) SELECTIVELY POWERING AN ELECTRICAL SUBMERSIBLE PUMP ASSEMBLY

(71) Applicant: Saudi Arabian Oil Company, Dhahran (SA)

(72) Inventors: Jinjiang Xiao, Dhahran (SA); Jamie Matthew Cochran, Inverurie (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/008,060

(22) Filed: Jan. 2, 2025

(65) Prior Publication Data

US 2026/0185429 A1 Jul. 2, 2026

(51) Int. Cl.

| | |
|---|---|
| ***E21B 43/12*** | (2006.01) |
| ***E21B 17/00*** | (2006.01) |
| ***E21B 17/02*** | (2006.01) |
| ***E21B 17/20*** | (2006.01) |
| ***E21B 19/16*** | (2006.01) |
| ***E21B 33/04*** | (2006.01) |

(Continued)

(52) U.S. Cl.

CPC ..... *E21B 43/128* (2013.01); *E21B 17/023* (2013.01); *E21B 17/028* (2013.01); *E21B 17/003* (2013.01); *E21B 17/026* (2013.01); *E21B 17/206* (2013.01); *E21B 19/165* (2013.01); *E21B 33/0407* (2013.01); *E21B 44/005* (2013.01); *E21B 47/008* (2020.05)

(58) Field of Classification Search

CPC combination set(s) only.

See application file for complete search history.

(56) References Cited

U.S. PATENT DOCUMENTS 5,058,683 A 10/1991 Godfrey et al.
5,455,573 A 10/1995 Delatorre
(Continued)

FOREIGN PATENT DOCUMENTS

WO 2017099968 A1 6/2017

OTHER PUBLICATIONS

U.S. Appl. No. 19/008,267, filed Jan. 2, 2025, Cochran.
(Continued)

*Primary Examiner* — Binh Q Tran
(74) *Attorney, Agent, or Firm* — Dinsmore & Shohl LLP

(57) ABSTRACT

A completion assembly to be disposed in a wellbore to produce a hydrocarbon. The completion assembly has electrical conductors, a docking station for an electrical submersible pump assembly, and a downhole electrical connector selector. The docking station is coupled to the electrical conductors in the wellbore and has multiple electrical connectors to flow electricity from the electrical conductors to the electrical submersible pump assembly. The downhole electrical connector selector couples to the docking station between the docking station and the electrical submersible pump assembly. The downhole electrical connector selector is configurable to switch between a first subset of the electrical connectors and a second subset of electrical connectors to control a flow of electricity from the electrical connectors of the docking station to the electrical submersible pump assembly to maintain the flow of electricity to the electrical submersible pump assembly.

17 Claims, 18 Drawing Sheets

(51) Int. Cl.
*E21B 44/00* (2006.01)
*E21B 47/008* (2012.01)

(56) References Cited

U.S. PATENT DOCUMENTS

| | | | | |
|---|---|---|---|---|
| 6,167,965 | B1 * | 1/2001 | Bearden | E21B 47/0175 417/18 |
| 7,640,993 | B2 | 1/2010 | Head | |
| 7,775,275 | B2 | 8/2010 | Patel | |
| 7,814,969 | B2 | 10/2010 | Shaw | |
| 9,166,352 | B2 | 10/2015 | Hansen | |
| 9,322,252 | B2 | 4/2016 | Head | |
| 9,627,862 | B2 * | 4/2017 | Hytten | E21B 43/017 |
| 10,396,540 | B2 | 8/2019 | Mangum | |
| 11,105,160 | B2 | 8/2021 | Leismer et al. | |
| 11,118,404 | B2 | 9/2021 | Leismer et al. | |
| 11,199,079 | B2 | 12/2021 | Tiwari | |
| 11,441,363 | B2 | 9/2022 | Bishop et al. | |
| 11,585,161 | B2 | 2/2023 | Wetzel | |
| 11,634,976 | B2 | 4/2023 | Wetzel | |
| 2003/0085815 | A1 | 5/2003 | Tilton et al. | |
| 2006/0196668 | A1 | 9/2006 | Burge | |
| 2007/0289740 | A1 * | 12/2007 | Thigpen | E21B 43/12 166/250.01 |
| 2008/0026623 | A1 * | 1/2008 | Emerson | E21B 43/128 439/275 |
| 2011/0011596 | A1 | 1/2011 | Martinez | |
| 2011/0024104 | A1 | 2/2011 | Griffiths | |
| 2012/0118563 | A1 | 5/2012 | Tetzlaff et al. | |
| 2014/0020907 | A1 | 1/2014 | Head | |
| 2018/0179860 | A1 * | 6/2018 | McMullen | H02M 3/04 |
| 2019/0292889 | A1 | 9/2019 | Hansen | |
| 2020/0080388 | A1 | 3/2020 | Leismer et al. | |
| 2020/0300068 | A1 | 9/2020 | Shaw et al. | |
| 2020/0362867 | A1 * | 11/2020 | Fox | F04D 15/0066 |
| 2021/0140247 | A1 | 5/2021 | Bishop et al. | |
| 2021/0189805 | A1 | 6/2021 | Beck et al. | |
| 2022/0200343 | A1 | 6/2022 | Pihl | |
| 2022/0268131 | A1 * | 8/2022 | Alghamdi | E21B 33/0385 |
| 2023/0075553 | A1 | 3/2023 | Firth et al. | |
| 2023/0335943 | A1 * | 10/2023 | Obermeyer | H02K 5/132 |

OTHER PUBLICATIONS huntingplc.com [online], "Otis X Running Tool," available on or before Jul. 1, 2024, via Internet Archive: Wayback Machine URL<https://web.archive.org/web/20240701025936/https://cdn.sanity.io/files/bwa44qrg/production/9ac3f8726c85fcb0d3040d1b089b46fd7bedcbc0.pdf>, retrieved on Jan. 15, 2025, retrieved from URL<https://media.huntingplc.com/products-and-services/well-intervention-equipment/slickline-equipment/halliburton-oem-tools/hunting-otis-x-running-tool-datasheet.pdf>, 1 page.

Spagnolo et al., "First Successful Replacement of Fully Retrievable ESP by Slickline," Society of Petroleum Engineers, SPE-192839-MS, prepared for presentation at the Abu Dhabi International Petroleum Exhibition & Conference, Abu Dhabi, UAE, Nov. 12-15, 2018, pp. 1-13, 13 pages.

Vielma et al., "ESP Retrievable Technology: a Solution to Enhance ESP Production While Minimizing Costs," Society of Petroleum Engineers, SPE 156189, prepared for presentation at the SPE International Production and Operations Conferences, Doha, Qatar, May 14-16, 2012, pp. 1-14, 14 pages.

Notification of Transmittal of the International Search Report and the Written Opinion of the International Searching Authority, or the Declaration dated Jun. 9, 2026 pertaining to International application No. PCT/US2025/061828 filed Dec. 31, 2025, pp. 1-19.

* cited by examiner

SELECTIVELY POWERING AN ELECTRICAL SUBMERSIBLE PUMP ASSEMBLY

TECHNICAL FIELD

This disclosure relates to selectively powering an electrical submersible pump assembly in a wellbore, for example, with a downhole electrical connector selector coupled to a docking station.

BACKGROUND

Hydrocarbons are trapped in reservoirs in subterranean formations of the Earth. Wellbores are drilled through subterranean formations to access those reservoirs. A completion system with an electrical submersible pump can be placed in the wellbore to raise the hydrocarbons to the surface of the Earth. Sometimes, the electrical cables or electrical connections to the electrical submersible pump can fail, halting production and requiring replacement of the completion system and electrical submersible pump to restore the wellbore to operation.

Completion assemblies can be placed wells to flow the hydrocarbons to the surface of the Earth. For example, gas lift assemblies, pump jacks, and electric submersible pump assemblies (ESPs). An ESP completion assembly can include an electric pump submersed in the production fluids in the well. The electric pump can be powered by electricity transferred downhole from the surface of the Earth to the electric pump. Sometimes, electrical connectors electrically coupling the electric pump to the supplied electrical power can fail due to elevated temperatures or a failure of isolation barriers against contaminants and the production fluids.

SUMMARY

This disclosure relates to selectively powering an electrical submersible pump assembly in a wellbore. A completion assembly can be disposed in the wellbore extending from a surface of the Earth to a hydrocarbon reservoir to produce a hydrocarbon. The completion assembly has multiple electrical conductors, a docking station coupled to the electrical conductors, and a downhole electrical connector selector configured to couple to the docking station between the docking station and an electrical submersible pump assembly. The electrical conductors extend from the surface of the Earth to the docking station at a downhole location in the wellbore.

The docking station is configured to receive an electrical submersible pump assembly. The docking station is coupled to the electrical conductors in the wellbore. The docking station includes multiple electrical connectors coupled to the electrical conductors and configured to flow electricity from the electrical conductors to the electrical submersible pump assembly.

The downhole electrical connector selector is configured to couple to the docking station between the docking station and the electrical submersible pump assembly. The downhole electrical connector selector is configurable to switch between a first subset of electrical connectors and a second subset of electrical connectors to control a flow of electricity from the electrical connectors of the docking station to the electrical submersible pump assembly to maintain the flow of electricity to the electrical submersible pump assembly.

When one or more of the electrical connectors of the first subset of electrical connectors or the electrical conductor coupled to one or more of the electrical connectors of the first subset of electrical connectors fails, the electrical submersible pump assembly can be removed, the downhole electrical connector selector can be reconfigured to couple to the second subset of electrical connectors, and the electrical submersible pump assembly can be placed at the same location and coupled to the docking station by the reconfigured downhole electrical connector selector to provide a continuity of power at the same downhole location. These replacement operations can be performed without replacing the entire production tubing because of multiple redundant electrical connectors which can be selected by the downhole electrical connector selector.

Implementations of the present disclosure can realize one or more of the following advantages. For example, this approach can reduce downtime required for completion assembly repairs. By installing multiple redundant electrical connectors and a reconfigurable downhole electrical connector selector for a single electrical submersible pump assembly, other electrical connectors are available to be used in the event of a failure of the previously used electrical connector, without requiring removal of the entire production tubing. For example, the failed electrical submersible pump can be changed out without using a drilling rig, and instead, can be changed out with a workover rig, slickline unit, wireline unit, or coiled tubing unit using established common well intervention techniques.

This approach can also improve completion assembly reliability. Reliability refers to the ability of a system to perform its intended function without failure, while redundancy refers to the use of backup components or systems to prevent or mitigate the consequences of a failure. For example, by placing multiple redundant selectable electrical connectors at a single location and protecting the unused electrical connectors, the overall reliability of a system can be improved.

Implementations of this present disclosure can also simplify workover operations performed on the wellbore. For example, the completion assembly and methods described here can eliminate the use of a tubing rig because an entire conventional production string no longer needs to be removed and replaced to restore production flow when a single electrical connector for an electrical submersible pump assembly fails in the conventional production string. Instead, using the completion assembly described in the present disclosure, a downhole conveyance such as a coiled tubing unit can remove an electrical submersible pump assembly, an operator can reconfigure the electrical submersible pump assembly, and the downhole conveyance can replace the reconfigured electrical submersible pump assembly faster and more efficient, while the rest of the completion assembly remains in place in the wellbore.

This approach can also enable testing of electrical connectors and electrical conductors (power cables or electrical cables). For example, by latching a test assembly to the multiple electrical connectors, proper functioning of all phases of the electrical system in the wellbore can be investigated. Electrical failures can be detected earlier.

This approach can also improve the cleanliness of downhole electrical connectors. For example, sometimes debris can be deposited in the electrical connectors or corrosion can build up in the electrical connectors in docking stations. Engaging and disengaging the test connector into and out of the electrical connectors can agitate the debris or corrosion can be agitated and cleared away from the electrical connectors. In some cases, the resistance between the test assembly and the electrical connectors can be decreased, subsequently improving the electrical flow between the installed electrical submersible pump assembly and the downhole electrical connection and further increasing the useful lifetime of the completion assembly.

DETAILED DESCRIPTION

The present disclosure describes systems and methods for selectively powering an electrical submersible pump assembly. Sometimes, a completion assembly can be placed in the wellbore to pressurize and move fluids in the wellbore from a downhole location to an uphole location and onward to a surface of the Earth. The completion assembly has multiple electrical conductors and a docking station for an electrical submersible pump assembly. The electrical conductors extend from a surface of the Earth to a downhole location in the wellbore. The docking station is coupled to the electrical conductors in the wellbore. The docking station has multiple electrical connectors configured to flow electricity from the electrical conductors to the electrical submersible pump assembly. The completion assembly includes a downhole electrical connector selector configured to mechanically and electrically couple an electrical submersible pump assembly to the electrical connectors of the docking station. The downhole electrical connector selector is configurable to switch between a first subset of the electrical connectors and a second subset of the electrical connectors to control a flow of electricity from the electrical connectors of the docking station to the electrical submersible pump assembly to maintain the flow of electricity to the electrical submersible pump assembly. Sometimes, one or more of the electrical conductors or the electrical connectors can fail, resulting in a loss of electricity supplied to the electrical submersible pump assembly. The downhole electrical connector selector can be reconfigured to electrically couple to the second subset of electrical connectors to maintain the flow of electricity to the electrical submersible pump assembly. These systems and methods can enable an efficient approach to producing fluids including hydrocarbons and water from a subterranean hydrocarbon reservoir into the wellbore by using an easily reconfigurable downhole electrical connector selector to maintain the flow of electricity to the electrical submersible pump assembly.

Figure 1:
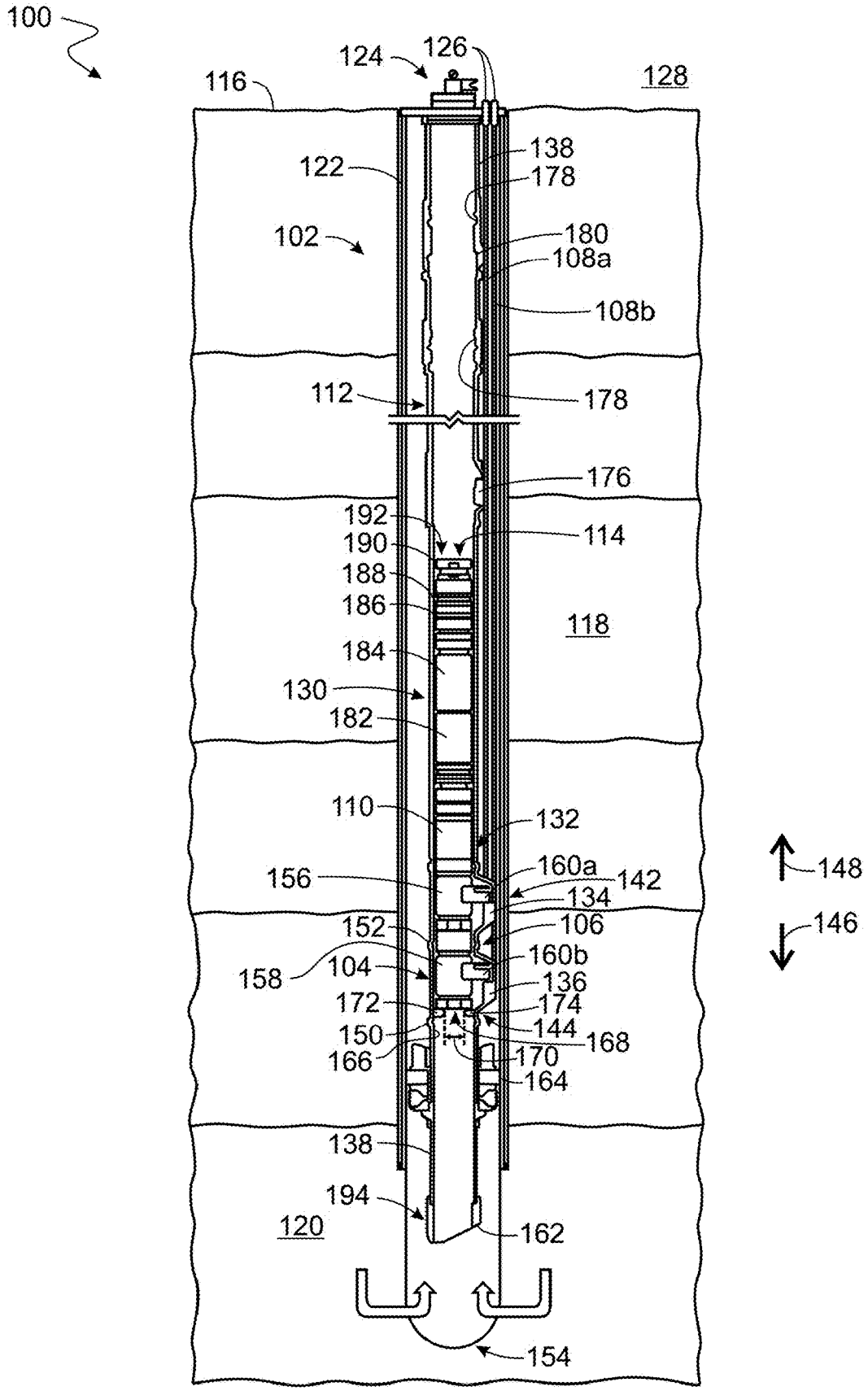
FIG. 1 shows a first completion assembly having a side pocket mandrel docking station in a wellbore using a side pocket mandrel downhole electric selector to transfer power from electrical cables to an electrical submersible pump assembly.

FIG. 1 shows a first completion assembly 100 in a wellbore 102 using a side pocket mandrel downhole electrical connector selector 104 and a side pocket mandrel docking station 106 to transfer power from electrical cables 108*a-b* (i.e., electrical conductors) to an electric motor 110 of an electrical submersible pump assembly 130 so the first completion assembly 100 can flow wellbore fluids through the wellbore 102. The side pocket mandrel downhole electrical connector selector 104 is coupled to the side pocket mandrel docking station 106 to electrically and physically connect a fixed portion 112 of the completion assembly 100 and removable portion 114 of the completion assembly 100 (including the electrical submersible pump assembly 130) so the removable portions 114 can be retrieved from the wellbore 102 after an electrical failure, the side pocket mandrel downhole electrical connector selector 104 reconfigured, and the removable portions, including the side pocket mandrel downhole electrical connector selector 104 replaced in the wellbore 102 to continue supplying power to the electric motor 110. The side pocket mandrel docking station 106 has electrical connectors 202*a-c* and 204*a-c*, shown and described in detail in reference to FIGS. 2A-2D, which are coupled to the electrical cables 108*a-b*, respectively. The electrical connectors 202*a-c* and 204*a-c* extend through the side pocket mandrel docking station 106 to transfer electricity to the side pocket mandrel downhole electrical connector selector 104 and couple to the side pocket mandrel downhole electrical connector selector 104. The side pocket mandrel downhole electrical connector selector 104 is configurable to switch between one or more combinations of the electrical connectors 202*a-c* and 204*a-c* to control a flow of electricity from the electrical cables 108*a-b* to the electrical submersible pump assembly 130 to maintain the flow of electricity to the electrical submersible pump assembly 130.

The completion assembly 100 is deployed in the wellbore 102, which extends from a surface 116 of the Earth through subterranean formations 118 to one or more of the subterranean formations having a hydrocarbon reservoir 120. The hydrocarbon reservoir 120 contains reservoir fluids such as water and hydrocarbons in the form of liquids and gases. The completion assembly 100 conducts the reservoir fluids from the hydrocarbon reservoir 120 to the surface 116 for collection, transportation, and refinement.

The completion assembly 100 includes a casing 122 positioned within the wellbore 102. The casing 122 can include one or more components or strings such as a conductor, a surface casing, an intermediate casing, a production string, a liner, packers, and/or shoes to couple the casing to the subterranean formations 118. The casing 122 can include one or more pieces of steel pipe and cement to couple the casing 122 to the wellbore 102. The completion assembly 100 is part of the fixed portion 112.

The completion assembly 100 includes a production tubing 138 positioned within the casing 122. The side pocket mandrel docking station 106 is coupled to the production tubing 138. The production tubing 138 and the side pocket mandrel docking station 106 are part of the fixed portion 112 of the completion assembly 100. The casing 122 and the production tubing 138 define an annulus 132. The production tubing 138 holds the side pocket mandrel docking station 106 in position within the wellbore 102.

The completion assembly 100 has a wellhead assembly 124 with a Christmas tree positioned at the surface 116 of the Earth and coupled to the casing 122. The wellhead assembly 124 seals the fluids in the casing 122 and controls the flow of the fluids into and out of the wellbore 102. The fixed portion 112 of the completion assembly 100 is coupled to the wellhead assembly 124 at the surface 116. The wellhead assembly 124 has a tubing head and a tubing hanger to couple the fixed portion 112 of the completion assembly 100 to the wellhead assembly 124.

The wellhead assembly 124 has one or more electrical cable wellhead penetrators 126 extending from outside 128 the wellbore 102 into the wellbore 102 to pass electricity from the surface through the electrical cables 108*a-b* outside 128 the wellbore 102 to the side pocket mandrel docking station 106. The electrical cable wellhead penetrators 126 inhibit fluids from the wellbore 102 from leaking through the wellhead assembly 124 to outside 128 the wellhead assembly 124.

The electrical cables 108*a-b* extend from the wellhead assembly 124 to the side pocket mandrel docking station 106 through the annulus 132 to the side pocket mandrel docking station 106 and transfer electricity to electrically powered downhole components such as the electrical submersible pump assembly 130, shown in FIG. 1 as electrically and mechanically connected to the side pocket mandrel docking station 106. The electrical submersible pump assembly 130 is part of the removable portion 114 of the completion assembly 100 and includes the electric motor 110. The electrical submersible pump assembly 130 increases a pressure of the reservoir fluids in the wellbore 102 received from the hydrocarbon reservoir 120 and flows the reservoir fluids to the surface 116 of the Earth. The electrical submersible pump assembly 130 is described in more detail below in reference to FIG. 1.

In some cases, the electrical cables 108*a-b* each have three cables to supply three-phase electrical power downhole to the side pocket mandrel docking station 106 at different axial and radial locations on the side pocket mandrel docking station 106. Although the wellhead assembly 124 is shown as having two electrical cable wellhead penetrators 126 and two electrical cables 108*a-b*, any appropriate number of electrical cable wellhead penetrators 126 and electrical cables 108*a-b* can be used.

In some implementations, the electrical cables 108*a-b* are round cables. Alternatively, the electrical cables 108*a-b* can be flat cables. Any suitable type of electrical cable can be used to connect to the side pocket mandrel docking station 106. In some implementations, each conductor of the electrical cables 108*a-b* can be split out into three separate cables, one for each phase, and each of the three separate cables can be protected by a metal jacket to increase life in harsh environments, such as below the production packer. This can be referred to as an all metal motor lead extension.

Referring to FIGS. 1 and 2A-2D, the side pocket mandrel docking station 106 has a first side pocket 134 and a second side pocket 136. The electrical connectors 202*a-c* are positioned in the first side pocket 134 and the electrical connectors 204*a-c* are positioned in the second side pocket 136. The electrical connectors 202*a-c* extend through the first side pocket 134 and the electrical connectors 204*a-c* extend through the second side pocket 136 from the annulus 132 to a space within the production tubing 138. The electrical connectors 202*a-c* are electrically coupled to electrical cable 108*a*. The electrical connectors 202*a-c* receive and transfer electricity from the electrical cable 108*a* through the first side pocket 134 to the side pocket mandrel downhole electrical connector selector 104. The electrical connectors 204*a-c* are electrically coupled to electrical cable 108*b*. The electrical connectors 204*a-c* receive and transfer electricity from the electrical cable 108*b* through the second side pocket 136 to the side pocket mandrel downhole electrical connector selector 104. The side pocket mandrel downhole electrical connector selector 104 is configurable to select one or more of the electrical connectors 202*a-c* and the electrical connectors 204*a-c* to supply electricity from electrical connectors 202*a-c* and the electrical connectors 204*a* through the side pocket mandrel downhole electrical connector selector 104 to the electric motor 110 of the electrical submersible pump assembly 130.

The first side pocket 134 is coupled to the production tubing 138 at a first downhole location 142 within the wellbore 102. The second side pocket 136 is coupled to the first side pocket 134 and positioned at a second downhole location 144 in a downhole direction 146 from the first side pocket 134. The downhole direction 146 is away from the surface 116 of the Earth and toward a bottom hole location 154 of the wellbore 102.

The electrical connectors 202*a-c* are positioned at the first downhole location 142 along the same circumferential location of the first side pocket 134 (i.e., the same height in the first side pocket 134 and in the wellbore 102). The electrical connectors 204*a-c* are positioned at the second downhole location 144 along the same circumferential location of the second side pocket 136 (i.e., the same height in the second side pocket 136 and in the wellbore 102), but spaced apart from the electrical connectors 204*a-c*. In some implementations, the electrical connectors 202*a-c* and the electrical connectors 204*a-c* can be spaced apart by between five and ten feet.

The electrical connectors 202*a-c* and the electrical connectors 204*a-c* are installed on the same axial line. The axial line is a vertical axis parallel to the length of the wellbore 102 (when the wellbore 102 is a vertical wellbore as shown in FIG. 1. The axial line is parallel to a central axis of the wellbore and the production tubing 138. The electrical connectors 202*a-c* and the electrical connectors 204*a-c* are arranged on top of one another and relative to each other on the removable portion 114 with similar radial orientation to one another in the uphole direction 148 and the downhole direction 146.

In this implementation, the electrical connectors 202*a-c* and the electrical connectors 204*a-c* are each aligned to ensure running clearance in the casing is optimized. The electrical connectors 202*a-c* and the electrical connectors 204*a-c* can be vertically aligned to a tolerance of less than 0.5 degrees.

The orientation and alignment of the electrical connectors 202*a-c* and the electrical connectors 204*a-c* with one another may be performed using various methods. For example, a Computer Numerical Control (CNC) machine may be used to accurately cut a threaded connection between components such that the mated threads match the required assembly orientation. For example, one or more spacer rings or shim rings such as laminated/peelable shims may be located between threaded connections to space out the components. An adjustable union, such as a rotational alignment sub, a turnbuckle threaded union with an alignment groove and first connector, or a flanged connection may be used to align/orient the components. Furthermore, and as outlined above, a landing profile 150, described below in more detail, and a side pocket rotational orienting sub 152 may be used to ensure that the electrical connectors 202*a-c* and the electrical connectors 204*a-c* are aligned and oriented properly downhole. The side pocket rotational orienting sub 152 can include a pin or protrusion and the side pocket mandrel docking station 106 (the first side pocket 134 and/or the second side pocket 136) can have an angled shoulder, that, when contacted, causes the pin or protrusion on the side pocket rotational orienting sub 152 to rotate into alignment.

In this implementation, the electrical connectors 202*a-c* and the electrical connectors 204*a-c* are pins, i.e., male-type protrusions or cylinders extending in the uphole direction 148. The uphole direction 148 is opposite the downhole direction 146. The uphole direction is toward the surface 116 of the Earth and away from the bottom hole location 154. Alternatively, the electrical connectors 202*a-c* and the electrical connectors 204*a-c* can be a female socket, a housing shaped to receive a pin, retractable pins, or pressure sensitive pins. The electrical connectors 202*a-c* and the electrical connectors 204*a-c* are an electrically conductive material that, when connected to the side pocket mandrel downhole electrical connector selector 104, conducts electricity from the respective electrical cable 108*a-b* to the side pocket mandrel downhole electrical connector selector 104.

In this implementation, three electrical connectors 202*a-c* and three electrical connectors 204*a-c* are used. Alternatively, in other implementations, between one and seven, or even more than seven electrical connectors, can be used each of the first side pocket 134 and the second side pocket 136. For example, in some embodiments, four electrical connectors can be positioned at the first side pocket 134 and the second side pocket 136.

The side pocket mandrel downhole electrical connector selector 104 has a first shuttle motor connector 156 configured to couple to the first side pocket 134 and a second shuttle motor connector 158 configured to couple to the second side pocket 136. The first shuttle motor connector 156 and the second shuttle motor connector 158 each have a head 160*a-b* which, when the respective shuttle motor connector 156, 158 is positioned at the respective side pocket 134, 136 and rotated, extends into the respective side pocket 134, 136 to mechanically contact the respective side pocket 134, 136 and electrically couple the respective shuttle motor connector 156, 158 to the electrical connectors 202*a-c* and electrical connectors 204*a-c*.

The first shuttle motor connector 156 and the second shuttle motor connector 158 each have electrical connectors that mate with the electrical connectors 202*a-c* and electrical connectors 204*a-c* to form an electrical connection between the side pocket mandrel downhole electrical connector selector 104 and the electrical cables 108*a-b*. The number of connectors in each of the first shuttle motor connector 156 and the second shuttle motor connector 158 equals the number of electrical connectors 202*a-c* and electrical connectors 204*a-c* to which they are coupled. When the first shuttle motor connector 156 and the second shuttle motor connector 158 enter their respective side pocket 134, 136, the first shuttle motor connector 156 and the second shuttle motor connector 158 are moved in the downhole direction 146 and couple with the electrical connectors 202*a-c* and electrical connectors 204*a-c* and mechanical contact and electrical contact is formed.

The number of electrical connectors in each of the first shuttle motor connector 156 and the second shuttle motor connector 158 equals the phases of winding in the electric motor 110. The electrical connectors 204*a-c* act as back up electrical connectors when a failure occurs to one or more of the electrical connectors 202*a-c*.

The electrical connectors of the first shuttle motor connector 156 and the second shuttle motor connector 158 are installed on the same axial line to properly couple with the electrical connectors 202*a-c* and electrical connectors 204*a-c*. The electrical connectors of the first shuttle motor connector 156 and the second shuttle motor connector 158 are axially arranged on top of one another with similar radial orientation to one another (e.g., a tolerance of less than 0.5 degrees). The vertical spacing of the heads 160*a-b* is substantially the same as the spacing between the electrical connectors 202*a-c* and electrical connectors 204*a-c* so the first shuttle motor connector 156 and the second shuttle motor connector 158 properly mates and seals with the electrical connectors 202*a-c* and electrical connectors 204*a-c*. For example, the first shuttle motor connector 156 and the second shuttle motor connector 158 are located within five to ten feet of one another.

In this implementation, the electrical connectors 202*a-c* and 204*a-c* of the first shuttle motor connector 156 and the second shuttle motor connector 158 are sockets (female) configured to receive the pins of the electrical connectors 202*a-c* and electrical connectors 204*a-c*. However, any suitable configuration of electrical connector may be used. For example, one of the electrical connectors may be a pin and the other may be a housing for the pin or both electrical connectors may be pins that touch to form the electrical connection. For example, the electrical connectors 202*a-c* and 204*a-c* can be socket contacts that mate with pins.

The first shuttle motor connector 156 and the second shuttle motor connector 158 each have an internal void through which reservoir fluids can flow through to reach the surface 116. The interval voids of the first shuttle motor connector 156 and the second shuttle motor connector 158 are fluidly coupled to pass the reservoir fluids from the production tubing 138 below the second shuttle motor connector 158 through the electrical submersible pump assembly 130 to the production tubing 138 and on to the wellhead assembly 124. Each phase is isolated from the other phases with insulated conductors. When running two shuttle motor connectors 156, 158, each phase can be joined electrically inside the connector body so each phase is protected and sealed from the wellbore fluids.

The shuttle motor connectors 156, 158 are coupled to the motor 110 mechanically and electrically. The shuttle motor connectors 156, 158 are mechanically coupled to the motor 110 by a flanged or threaded connection. the shuttle motor connectors 156, 158 are coupled to the motor 110 electrically by each phase being connected with internal conductors. For example, each phase can be coupled with contacts crimped at either end and sealed with insulators.

In this implementation, two side pockets 134 and 136 provided for in the side pocket mandrel docking station 106, and likewise, the side pocket mandrel downhole electrical connector selector 104 includes the first shuttle motor connector 156 and the second shuttle motor connector 158. However, in order to provide further levels of redundancy, additional side pockets may be included in the side pocket mandrel docking station 106 (i.e., in the fixed portion 112 of the completion assembly 100) and corresponding shuttle motor connectors may be included with the side pocket mandrel downhole electrical connector selector 104.

Referring to FIGS. 2A-2D, the electrical connectors 202*a-c* and electrical connectors 204*a-c* are in various configurations to transfer electricity from the electrical cables 108*a-b* to the electric motor 110. The electrical cables

108*a-b* extend to the side pocket mandrel docking station 106. The electrical cable 108*a* is coupled to the first side pocket 134 which includes the electrical connectors 202*a-c*. The three phases 206*a-c* of the electrical cable 108*a* are coupled to the electrical connectors 202*a-c*. The electrical cable 108*b* is coupled to the second side pocket 136 which includes the electrical connectors 204*a-c*. The three phases 208*a-c* of the electrical cable 108*b* are coupled to the electrical connectors 204*a-c*. Once damage or failure resulting in a reduction or loss of electricity supplied to or through one or more of the electrical cables 108*a-b*, one or more of the phases 206*a-c* or 208*a-c*, or the electrical connectors 202*a-c* and electrical connectors 204*a-c* which are part of the fixed portion 112 of the completion assembly 100 is detected, the side pocket mandrel downhole electrical connector selector 104 can be removed from the wellbore 102, reconfigured to couple with another subset of non-failed electrical connectors 202*a-c* and electrical connectors 204*a-c*, and replaced in the wellbore 102 to couple the subset of still-functioning electrical connectors 202*a-c* and electrical connectors 204*a-c* to restore electricity flow to the electric motor 110 of the electrical submersible pump assembly 130. FIGS. 2A-2D show four examples of operational permutations and fault tolerances.

Figure 2B:
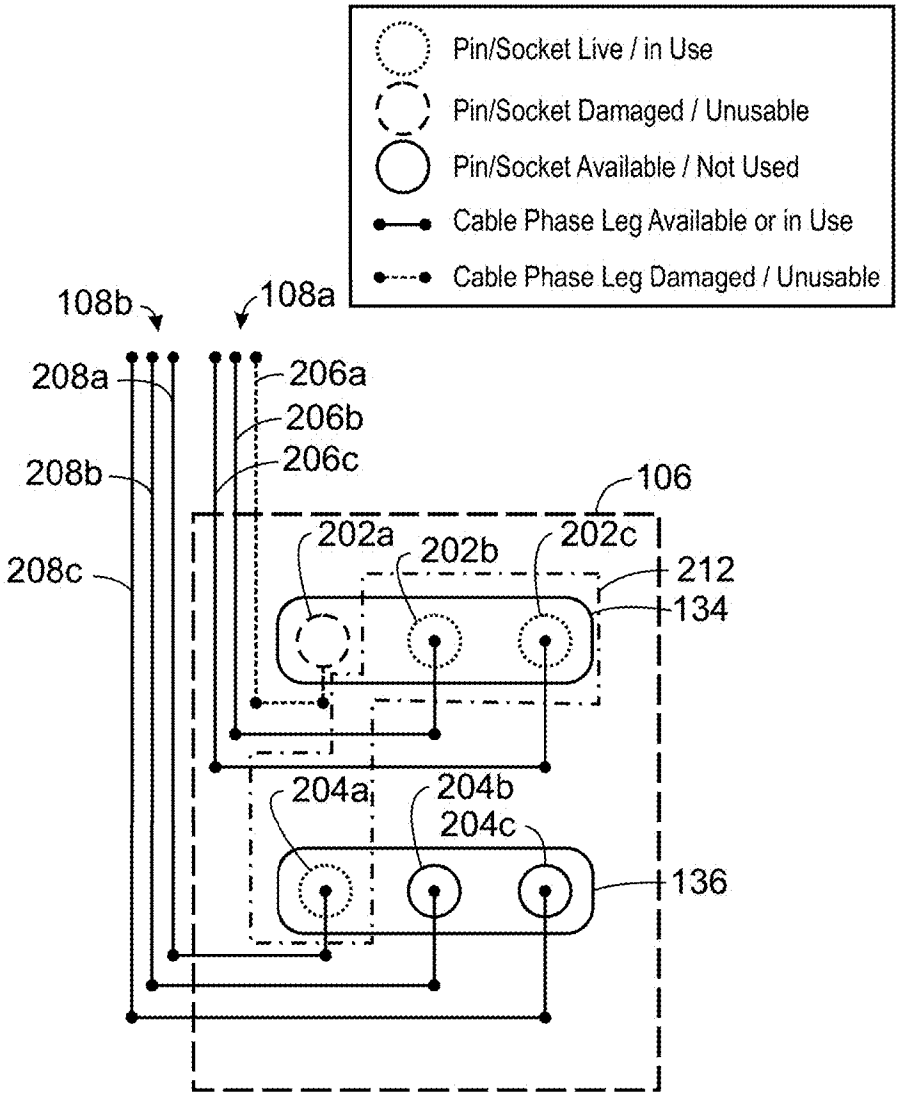
FIGS. 2A-2D show various configurations of the side pocket mandrel downhole electrical selector of FIG. 1.
Figure 2A:
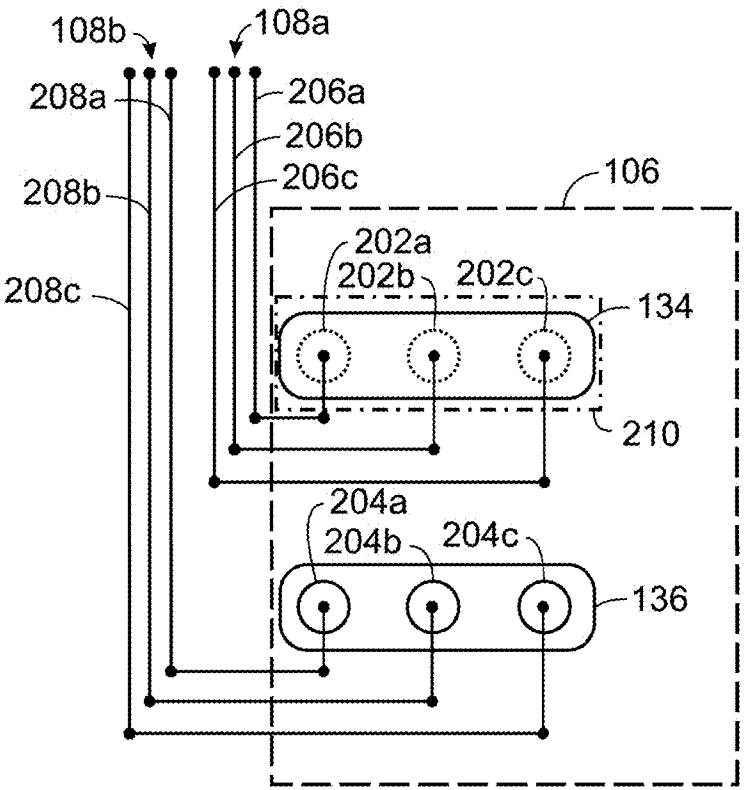

Referring to FIG. 2A, the side pocket mandrel downhole electrical connector selector 104 (not shown) is configured to receive electricity from the side pocket mandrel docking station 106 through the electrical connectors 202*a-c* which are powered by phases 206*a-c* of electrical cable 108*a*. Electrical connectors 202*a-c* and phases 206*a-c* of electrical cable 108*a* are capable of normal operation and conducting electricity to the side pocket mandrel docking station 106. Electricity flows from all three phases 206*a-c* of electrical cable 108*a* to each of the respective electrical connectors 202*a-c*. The electricity continues to flow from each of the electrical connectors 202*a-c* into the side pocket mandrel downhole electrical connector selector 104 and on to the electrical motor 110 of the electrical submersible pump assembly 130.

Electrical connectors 204*a-c* and phases 208*a-c* of electrical cable 108*b* are capable of normal operation to the side pocket mandrel docking station 106, however the side pocket mandrel downhole electrical connector selector 104 is not configured to receive and transfer electricity from electrical connectors 204*a-c* and phases 208*a-c* of electrical cable 108*b* to the electrical motor 110 of the electrical submersible pump assembly 130. Each head 160*a-b* is coupled in the respective side pockets 134, 136, however, the electrical connectors 204*a-c* coupled to the head 106*b* do not pass electricity into the second shuttle motor connector 158.

In the configuration shown in FIG. 2A, the electrical connectors 202*a-c* are a first subset 210 of all of the electrical connectors 202*a-c* and 204*a-c*. The first subset 210 (electrical connectors 202*a-c*) pass electricity to the side pocket mandrel downhole electrical connector selector 104. The side pocket mandrel downhole electrical connector selector 104 is configured to only receive electricity from the first subset 210 (electrical connectors 202*a-c*). The configuration of the side pocket mandrel downhole electrical connector selector 104 to receive and pass electricity from the first subset 210 to the electrical submersible pump assembly 130 can be referred to as an initial configuration, however, any configuration can be the initial configuration of the side pocket mandrel downhole electrical connector selector 104. In some implementations, the side pocket mandrel downhole electrical connector selector 104 can be initially configured to electrically couple to the electrical connectors 204*a-c* and electricity could flow from each of the three phases 208*a-c* through the electrical connectors 204*a-c* to power the electrical submersible pump assembly 130.

Referring to FIG. 2B, an electrical fault was detected in phase 206*a* of electrical cable 108*a* and/or electrical connector 202*a*. For example, an increase in resistance indicating an open or a decrease in resistance indicating a short can be detected. In some cases, corrosion or fluid ingress can occur into one or more of the electrical connectors 202*a-c* and 204*a-c* causing a short, a short to ground, or reduced electrical capacity. When at least one of these indications has been detected, the removable portion 114 (at least the electrical submersible pump assembly 130 including the side pocket mandrel downhole electrical connector selector 104) is removed. The side pocket mandrel downhole electrical connector selector 104 is reconfigured to no longer couple to the electrical connector 202*a*. The side pocket mandrel downhole electrical connector selector 104 is reconfigured to couple to the electrical connector 204*a* instead of 202*a*, replacing that phase of the three-phase electrical current. The side pocket mandrel downhole electrical connector selector 104 remains configured to electrically connect to the electrical connectors 202*b,c*. In this configuration, the head 106*a* is being used to supply two phases (phases 206*b,c*) of electrical power through electrical connectors 202*b,c* and one phase of electrical power through electrical connector 204*a* to the electrical motor 110, maintaining a supply of electricity to the electrical submersible pump assembly 130.

In the configuration shown in FIG. 2B, the electrical connectors 202*b,c* and 204*a* are a second subset 212 of all of the electrical connectors 202*a-c* and 204*a-c*. The second subset 212 (electrical connectors 202*b,c* and 204*a*) pass electricity to the side pocket mandrel downhole electrical connector selector 104. The side pocket mandrel downhole electrical connector selector 104 is configured to only receive electricity from the second subset 212 (electrical connectors 202*b,c* and 204*a*). In FIG. 2B, electrical connectors 204*b,c* are functional and capable of transferring electricity, however, the side pocket mandrel downhole electrical connector selector 104 is not configured to electrically couple to the electrical connectors 204*b,c*.

Figure 2D:
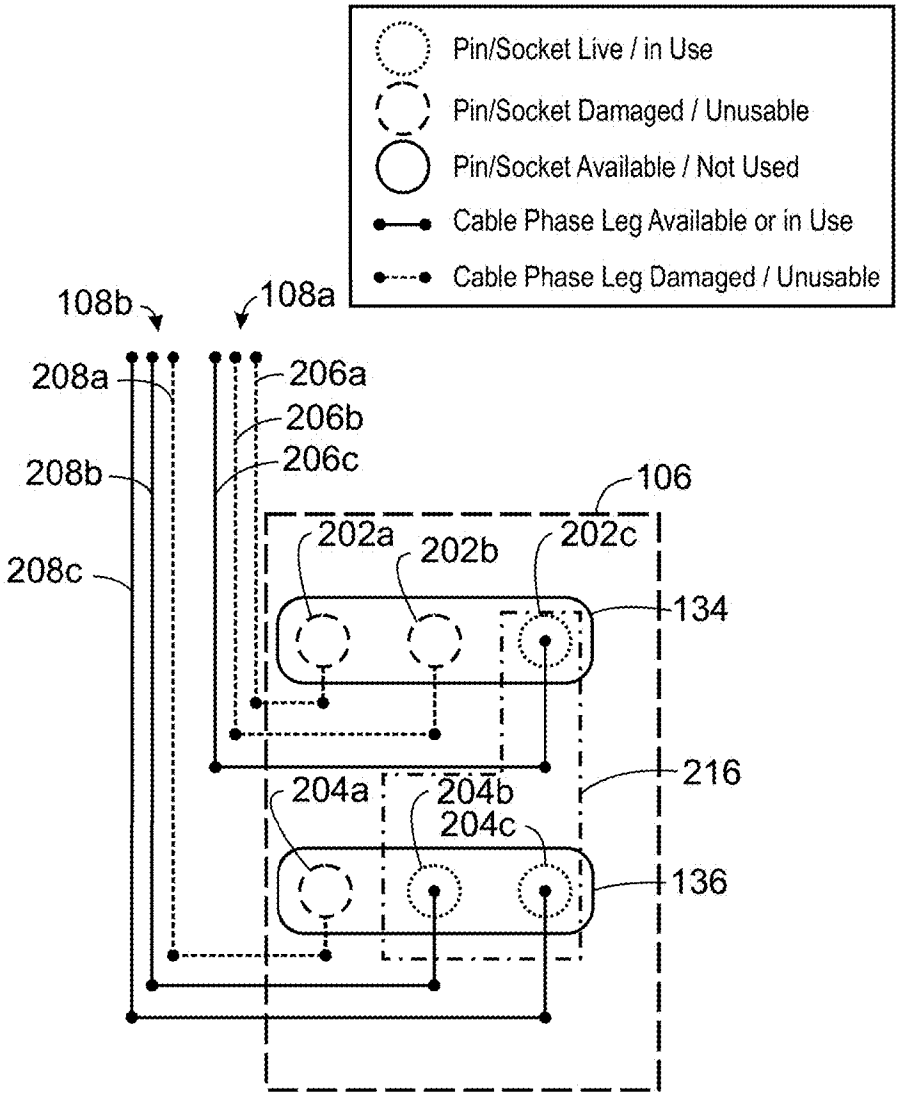
Figure 2C:
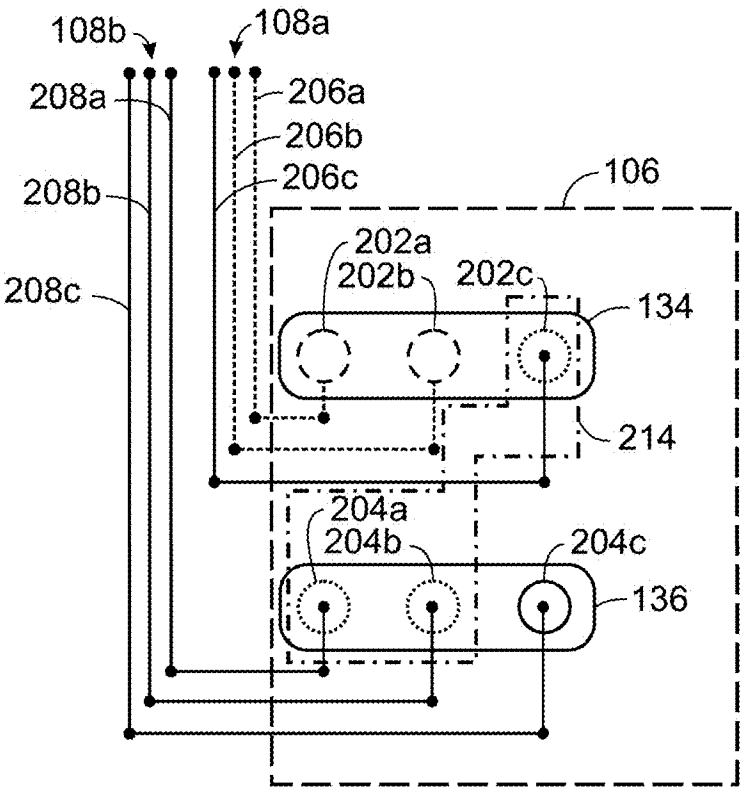

Referring to FIG. 2C, a subsequent electrical fault was detected in phase 206*b* of electrical cable 108*a* and/or electrical connector 202*b*. When at least one of these additional indications has been detected, the removable portion 114 (at least the electrical submersible pump assembly 130 including the side pocket mandrel downhole electrical connector selector 104) can be once again removed from the wellbore 102. The side pocket mandrel downhole electrical connector selector 104 is again reconfigured, but this time is reconfigured to no longer couple to the electrical connectors 202*a* and 202*b*. The side pocket mandrel downhole electrical connector selector 104 is reconfigured to couple to the electrical connector 204*b* instead of 202*b*, replacing that phase of the three-phase electrical current. The side pocket mandrel downhole electrical connector selector 104 remains configured to electrically connect to the electrical connectors 202*c*. In this configuration, the head 106*a* is being used to supply one phase (phases 206*c*) of electrical power through electrical connector 202*c* and two phases of electrical power through electrical connectors 204*a,b* to the electrical motor 110, maintaining a supply of electricity to the electrical submersible pump assembly 130.

In the configuration shown in FIG. 2C, the electrical connectors 202*c* and 204*a,b* are a third subset 214 of all of the electrical connectors 202*a-c* and 204*a-c*. The third subset 214 (electrical connectors 202*c* and 204*a,b*) pass electricity to the side pocket mandrel downhole electrical connector selector 104. The side pocket mandrel downhole electrical connector selector 104 is configured to only receive electricity from the third subset 214 (electrical connectors 202*c* and 204*a,b*). In FIG. 2C, electrical connector 204*c* is still functional and capable of transferring electricity, however, the side pocket mandrel downhole electrical connector selector 104 is not configured to electrically couple to electrical connector 204*c*.

Referring to FIG. 2D, yet another subsequent electrical fault was detected in phase 208*a* of electrical cable 108*b* and/or electrical connector 204*a*. When at least one of these additional indications has been detected, the removable portion 114 (at least the electrical submersible pump assembly 130 including the side pocket mandrel downhole electrical connector selector 104) can be once again removed from the wellbore 102. The side pocket mandrel downhole electrical connector selector 104 is yet again reconfigured, but this time is reconfigured to no longer couple to the electrical connector 202*a,b* and 204*a*. The side pocket mandrel downhole electrical connector selector 104 is reconfigured to couple to the electrical connector 204*c* instead of 204*a*, replacing that phase of the three-phase electrical current. The side pocket mandrel downhole electrical connector selector 104 remains configured to electrically connect to the electrical connectors 202*c*. In this configuration, the head 106*a* is being used to supply one phase (phases 206*c*) of electrical power through electrical connector 202*c* and two phases of electrical power through electrical connector 204*b,c* to the electrical motor 110, maintaining a supply of electricity to the electrical submersible pump assembly 130.

In the configuration shown in FIG. 2D, the electrical connectors 202*c* and 204*b,c* are a fourth subset 216 of all of the electrical connectors 202*a-c* and 204*a-c*. The fourth subset 216 (electrical connectors 202*c* and 204*b,c*) pass electricity to the side pocket mandrel downhole electrical connector selector 104. The side pocket mandrel downhole electrical connector selector 104 is configured to only receive electricity from the fourth subset 216 (electrical connectors 202*c* and 204*b,c*).

Although the electrical connectors 202*a-c* and 204*a-c* have been described as generally failing sequentially, they may fail in any order, and the side pocket mandrel downhole electrical connector selector 104 may be reconfigured in any desired order to maintain the flow of electricity from the functioning electrical connectors 202*a-c* and 204*a-c* using any desired combination of electrical connectors 202*a-c* and 204*a-c* may be used as the operating subset of electrical connectors 202*a-c* and 204*a-c*. Likewise, the side pocket mandrel downhole electrical connector selector 104 has been described as being reconfigured to only one electrical connector at a time, however, two or three, or even more when used, may be reconfigured at the same time.

The fixed portion 112 can be placed into and positioned with the wellbore 102 by downhole conveyance. For example, a wireline assembly, a drilling rig, or a workover rig can place the completion assembly 100 in the wellbore 102.

Returning to the fixed portion 112, the completion assembly 100 includes a wireline entry guide 162. The wireline entry guide 162 is positioned at a downhole end 194 of the fixed portion 112 and guides and protects the production tubing 138 as the fixed portion 112 is positioned in the wellbore 102.

The fixed portion 112 has a production packer 164. The production packer 164 is positioned between sections of production tubing 138 between the side pocket mandrel downhole electrical connector selector 104 and the downhole end 194 of the fixed portion 112. The production packer 164 expands to seal and couple the fixed portion 112 of the completion assembly to the wellbore 102. The production packer 164 reduced and/or prevents reservoir fluids from the hydrocarbon reservoir 120 in the wellbore 102 in the downhole direction 146 from the production packer 164 from moving through the annulus 132 from the downhole direction 146 of the production packer 164 to the uphole direction 148 of the production packer 164. Sometimes, reservoir fluids can leak by the production packer 164 and contact the side pocket mandrel docking station 106 and electrical cables 108*a-b*, causing corrosion and electrical faults. In this implementation, only one production packer 164 is used, however, any suitable number of production packers 164 may be included in the fixed portion 112 to further seal the annulus 132 from the ingress of reservoir fluids.

The fixed portion 112 has a landing profile 150 receives the removable portion 114 of the completion assembly 100. The landing profile 150 prevents movement of the removable portion 114 of the completion assembly 100 past the landing profile 150 and positions the side pocket mandrel electrical connector selector 104 in the production tubing 138 and the heads 160*a-b* relative to the first and second side pockets 134, 136 so the side pocket mandrel electrical connector selector 104 can be rotated and couple to the electrical connectors 202*a-c* and 204*a-c* properly. The landing profile 150 extends out from the inner circumferential surface 166 of the production tubing 138. In some cases, the landing profile 150 is a portion of production tubing 138 with a lip extending from the inner circumferential surface 166. In other implementations, the landing profile 150 is a separate component positioned between two sections of production tubing 138. The second shuttle motor connector 158 rests on the landing profile 150.

The landing profile 150 may be a permanent machined component or may be removable by being lockable into a nipple profile located in the fixed portion 112 downhole from the second side pocket 136 (i.e., the lowest side pocket).

The landing profile 150 defines an opening 168. The first and second shuttle motor connectors 156, 158 have interior voids through which generally align with the opening 168 to pass reservoir fluids from the downhole of the landing profile 150 through the opening 168 of the landing profile 150 to the interior voids of first and second shuttle motor connectors 156, 158.

The opening 168 of the landing profile 150 has an inner diameter 170 that is smaller than an outer diameter 172 of the first and second shuttle motor connectors 156, 158 so the first and second shuttle motor connectors 156, 158 rest on an upper surface 174 of the landing profile 150. The first and second shuttle motor connectors 156, 158 are sized to be larger than the opening 168 of the landing profile 150, thus, the entire removable portion 114 can sit on the landing profile 150. As such, the landing profile 150 is used as a base for the electrical submersible pump assembly 130. The landing profile 150 is positioned at or near the second side pocket 136 so the head 160*b* of the rests properly in the second side pocket 136.

In this implementation, the landing profile 150 is positioned in the uphole direction 148 from the production packer 164. However, in other implementations, the landing profile 150 may be positioned at any location within the production tubing 138 with sufficient space to hold the electrical submersible pump assembly 130 in the fixed portion 112 and still produce the reservoir fluids from the wellbore 102.

The fixed portion 112 includes a permanent gauge 176 to sense a condition of the completion assembly 100 or the wellbore 102. The permanent gauge 176 can transmit a signal representing a value of the condition to an operator. Based on the value of the condition of the completion assembly 100 or the wellbore 102, the operator can determine the condition of the completion assembly 100 or the wellbore 102. For example, the condition of the completion assembly 100 or the wellbore 102 can be a pressure or a temperature. Sometimes, one or more of the electrical components in the completion assembly 100 can fail. For example, one or more of the electrical cables 108*a-b* or the electrical connectors 20*a-c* or 204*a-c* can experience a short, an open, a decrease in resistance, or an increase in resistance. For example, the electric motor 110 of the electrical submersible pump assembly 130 can no longer receive power and reservoir fluids no longer reach the surface 116. The operator may desire to determine which component failed without removing the entire completion assembly 100 from the wellbore 102 to plan reconfiguring operations to maintain a continuity of power to the electrical submersible pump assembly 130 and continue producing the wellbore with a minimum of well downtime. Or, before installing a new electrical submersible pump assembly 130 in the completion assembly 100, the operator may want to confirm proper operation of the electrical cables 108*a-b* or one or more of the electrical connectors 202*a-c* and 204*a-c*. The permanent gauge 176 or other sensors within the wellbore 102 or at the surface 116 can be used to provide indications to the operator of these conditions.

The fixed portion 112 includes one or more R nipple profiles 178. The R nipple profiles 178 allow placement of additional completion components within the fixed portion 112 of the completion assembly 100. Although the nipples are shown as R-nipple profiles, any suitable nipple may be used.

The fixed portion 112 includes a sub-surface safety valve 180 to protect the completion assembly 100 from an overpressure condition. The sub-surface safety valve 180 can reduce a pressure within the completion assembly 100. The sub-surface safety valve 180 can automatically or responsive to an operator generated command signal from the surface 116 (i.e., a surface controlled sub-surface safety valve) to vent leaked reservoir fluid from within the completion assembly 100 into the annulus 132 to protect the completion assembly 100 from an overpressure condition.

The electrical submersible pump assembly 130 includes the electric motor 110, one or more protector seals 182, a pump 184 powered by the electric motor 110, a check valve 186, a packoff 188, and a tubing stop 190. The electric motor 110 is coupled to the side pocket mandrel electrical connector selector 104. The side pocket mandrel electrical connector selector 104 is positioned in the downhole direction 146 from the electric motor 110.

The protector seal 182 is positioned between the electric motor 110 and the pump 184 to prevent reservoir fluids from entering the electric motor 110. The protector seals 182 are positioned in the electrical submersible pump assembly 130 in the uphole direction 148 (i.e., closer to the surface 116) from the electric motor 110. In some implementations, the protector seals 182 include a seal section housing a thrust bearing. The thrust bearing can accommodate axial thrust from the pump 184 such that the electric motor 110 is protected from axial thrust. The protector seals 182 may also isolate the electric motor 110 from reservoir fluids. The protector seals 182 can equalize the pressure in the annulus 132 with the pressure in the electric motor 110.

The pump 184 is located in the uphole direction 148 from the electric motor 110. The pump 184 is operated by the electric motor 110 to pressurize the reservoir fluids and lifts the reservoir fluids to the surface 116. The pump 184 can include multiple stages to sequentially increase the pressure of the reservoir fluids. Each stage can contain a rotating impeller and stationary diffuser. As the reservoir fluids enter each stage, the reservoir fluids pass through the rotating impeller to be centrifuged radially outward. The reservoir fluids then enter the diffuser, and the pressure increases. As the reservoir fluids pass through each stage, the pressure continually increases until the pressure of the reservoir fluids reaches a discharge pressure and has sufficient energy to flow to the surface 116.

The check valve 186 is positioned in the uphole direction 148 from the discharge of the pump 184. The check valve 186 opens to allow pressurized reservoir fluids to flow from the discharge of the pump 184 to the surface 116. The check valve 186 closes when the pressure of the discharge of reservoir fluids from the pump 184 falls below a threshold pressure to prevent backflow in the downhole direction 146. The packoff 188 seals an uphole end 192 of the electrical submersible pump assembly 130 to prevent the pressurized reservoir fluids exiting the electrical submersible pump assembly 130 in the uphole direction 148 from flowing between the electrical submersible pump assembly 130 and the inner surface of the production tubing 138.

The tubing stop 190 is coupled to the packoff 188. The tubing stop 190 is positioned at the uphole end 192 of the electrical submersible pump assembly 130. The tubing stop 190 is configured to couple to a downhole conveyance so the downhole conveyance can place and retrieve the electrical submersible pump assembly 130 in the wellbore 102. The fixed portion 112 can be installed in the wellbore 102 after the wellbore 102 has been drilled and the casing 122 has been run and set in place. The fixed portion 112 can be installed using a rig that can support the weight and height of the production tubing 138. After the fixed portion 112 is installed, the removable portion 114 can be installed. The removable portion 114 may be installed initially using a rig or a rig-less operation. For example, a drilling rig, a workover rig, or a coiled tubing rig can be used to initially install the removable portion 114 in the fixed portion 112.

The electrical submersible pump assembly 130 can be installed within the fixed portion 112 in the wellbore 102 after the fixed portion 112 has been set in place in the wellbore 102. In a rig operation, the removable portion 114 may be lowered into the production tubing 138 using a drill pipe. The drill pipe may be releasably connected to the removable portion 114 by the tubing stop 190. However, a drilling rig is not required to place and remove the removable portion 114. The workover rig, the coiled tubing assembly, a wireline assembly, or a slickline assembly can be used to place and remove the removeable portion 114 from the fixed portion 112 in the wellbore 102.

The electrical submersible pump assembly 130 can include sensors to detect conditions of one or more of the electrical submersible pump assembly 130, the surrounding wellbore 102, the hydrocarbon reservoir 120, and subterranean formations 118. The conditions can include pump intake volumes, discharge pressures, temperatures, flow rates, and vibration.

FIGS. 3A-3G show a second completion assembly 300 having an axial docking station 302 using an axial downhole electrical connector selector 304 to transfer power from electrical cables 306*a,b* to the electrical submersible pump assembly 130. FIGS. 4A-4D show various configurations of the axial downhole electrical connecter selector 304 of FIG. 3A. The axial docking station 302 is coupled to the production tubing 138 in the fixed portion 112 of the completion assembly 300. The axial docking station 302 is coupled to the electrical cables 306*a,b* within the annulus 132. The axial docking station 302 conducts electricity from the electrical cables 306*a,b* into the inner portion of the production tubing 138 to the axial downhole electrical connector selector 304. The axial downhole electrical connector selector 304 electrically and physically couples to the axial docking station 302. The axial downhole electrical connector selector 304 is reconfigurable to maintain flow of electricity when a portion of the axial downhole electrical connector selector 304 or the electrical cables 306*a,b* have failed.

The axial downhole electrical connector selector 304 is coupled to the axial docking station 302 to electrically and physically connect the fixed portion 112 of the completion assembly 300 and removable portion 114 of the completion assembly 300 (including the electrical submersible pump assembly 130) so the removable portions 114 can be retrieved from the wellbore 102 after an electrical failure, the axial downhole electrical connector selector 304 reconfigured, and the removable portions including the axial downhole electrical connector selector 304 replaced in the wellbore 102 to continue supplying power the electric motor 110.

The axial docking station 302 has electrical socket connectors 308*a-c* (shown in FIG. 3B) and 310*a-c* which are arranged axially along a length 312 of the axial docking station 302. The length 312 is parallel to a center longitudinal axis 314 of the axial docking station 302. The electrical cables 306*a* and 306*b* are coupled to the electrical cable wellhead penetrators 126 at the surface of the Earth where they enter the wellbore 102. The electrical cables 306*a* and 306*b* extend from the electrical cable wellhead penetrators 126 to the axial docking station 302. The electrical cable 306*a* splits into three phases 316*a-c* (i.e., an individual wire or cable for each base). Phase 316*a* is electrically and physically coupled to the electrical socket connector 308*a*. Phase 316*b* is electrically and physically coupled to the electrical socket connector 308*b*. Phase 316*c* is electrically and physically coupled to the electrical socket connector 308*c*. The electrical cable 306*b* splits into three phases 318*a-c* (i.e., an individual wire or cable for each base). Phase 318*a* is electrically and physically coupled to the electrical socket connector 310*a*. Phase 318*b* is electrically and physically coupled to the electrical socket connector 310*b*. Phase 318*c* is electrically and physically coupled to the electrical socket connector 310*c*. The electrical socket connectors 308*a-c* and 310*a-c* are oriented to receive the axial downhole electrical connector selector 304. The electrical socket connectors 308*a-c* and 310*a-c* couple to and seal to the axial downhole electrical connector selector 304 to transfer electricity from the electrical cables 306*a* and 306*b* through one or more of the electrical socket connectors 308*a-c* and 310*a-c* to the axial downhole electrical connector selector 304, and then to the electric motor 110 of the electrical submersible pump assembly 130.

Electrical socket connectors 308*a* and 310*a* are positioned in a first axial plane 320 at a first location 322 along the length 312 of the axial docking station 302. Electrical socket connectors 308*b* and 310*b* are spaced apart from the electrical socket connectors 308*a* and 310*a* in the downhole direction 146. Electrical socket connectors 308*b* and 310*b* are positioned in a second axial plane 324 at a second location 326 along the length 312 of the axial docking station 302. Electrical socket connectors 308*c* and 310*c* are spaced apart from the electrical socket connectors 308*a* and 310*a*, and also spaced apart from electrical socket connectors 308*b* and 310*b*, in the downhole direction 146. Electrical socket connectors 308*c* and 310*c* are positioned in a third axial plane 328 at a third location 330 along the length 312 of the axial docking station 302.

The electrical socket connectors 308*a-c* and the electrical socket connectors 310*a-c* are arranged on top of one another with similar radial orientation to one another in the uphole direction 148 and the downhole direction 146. In this implementation, the electrical socket connectors 308*a-c* and the electrical socket connectors 310*a-c* are vertically aligned to a tolerance of less than 0.5 degrees to ensure proper sealing to the axial docking station 302.

Referring to FIGS. 3A-3B and 3D-3G, the axial docking station 302 has a rotational orienting pin 332 and a landing profile 334. The rotational orienting pin 332 and the landing profile 334 are configured to orient the axial downhole electrical connector selector 304 relative to the axial docking station 302 to couple the axial downhole electrical connector selector 304 the electrical socket connectors 308*a-c* and 310*a-c*.

The rotational orienting pin 332 extends from an inner surface 336 of the axial docking station 302. The rotational orienting pin 332 is configured to receive a rotational orienting feature 338 of the axial downhole electrical connector selector 304. The rotational orienting feature 338 is described in more detail in reference to FIG. 3C. The rotational orienting pin 332 is configured to couple to the rotational orienting feature 338 when the axial downhole electrical connector selector 304 has been coupled to the axial docking station 302. The rotational orienting pin 332 can be referred to as a shoulder. As described in more detail in reference to FIG. 3C, the rotational orienting feature 338 of the axial downhole electrical connector selector 304 slides along the rotational orienting pin 332 to force the axial downhole electrical connector selector 304 into alignment with the axial docking station 302 to couple the axial downhole electrical connector selector 304 the electrical socket connectors 308*a-c* and 310*a-c*. In some implementations, the rotational orienting pin 332 has sharp edges removed with a chamfer and be constructed from a hardened material to enable multiple engagements with minimal or no wear.

The landing profile 334 is a ramp configured to receive an orientation head 340 of the axial downhole electrical connector selector 304. The landing profile 334 extends across the inner surface 336 from a fourth location 342 to a fifth location 344 downhole from the fourth location 342 to form an angle rim. The landing profile 334 is configured to couple to the orientation head 340 when the axial downhole electrical connector selector 304 has been coupled to the axial docking station 302. As described in more detail in reference to FIG. 3C, the orientation head 340 of the axial downhole electrical connector selector 304 slides along the landing profile to force the axial downhole electrical connector selector 304 into alignment with the axial docking station 302 to couple the axial downhole electrical connector selector 304 the electrical socket connectors 308*a-c* and 310*a-c*. The landing profile 334 is defined by a top surface 346. The top surface 346 receives the orientation head 340.

The landing profile 334 has a void 350 extending from a bottom surface 348 to the top surface 346. The void 350 allows the passage of reservoir fluids from downhole of the axial docking station 302 through the axial docking station 302 to the axial downhole electrical connector selector 304. The shape and area of the landing profile 334 can be optimized to minimize fluid pressure drop and friction, with the edges rounded, and flow not directed in perpendicular directions to avoid erosional wear.

Referring to FIGS. 3A-3G, the axial downhole electrical connector selector 304 has electrical pin connectors 352*a-c* and 3354*a-c* (shown in FIG. 3C-3E) which are arranged axially along the axial downhole electrical connector selector 304 and are arranged to enter within and couple to the electrical socket connectors 308*a-c* and 310*a-c*, respectively. For example, the electrical pin connector 352*a* couples to the electrical socket connector 308*a*, the electrical pin connector 352*b* couples to the electrical socket connector 308*b*, the electrical pin connector 352*c* couples to the electrical socket connector 308*c*, the electrical pin connector 354*a* couples to the electrical socket connector 310*a*, the electrical pin connector 354*b* couples to the electrical socket connector 310*b*, and the electrical pin connector 354*c* couples to the electrical socket connector 310*c*. The electrical pin connectors 352*a-c* and 354*a-c* are oriented to enter into the electrical socket connectors 308*a-c* and 310*a-c* of the axial docking station 302. When the electrical pin connectors 352*a-c* and 354*a-c* contact the electrical socket connectors 308*a-c* and 310*a-c* electricity flows from the electrical cables 306*a* and 306*b* through one or more of the electrical socket connectors 308*a-c* and 310*a-c* to the configured electrical pin connectors 352*a-c* and 354*a-c* of the axial downhole electrical connector selector 304, and then to the electric motor 110 of the electrical submersible pump assembly 130.

Electrical pin connectors 352*a* and 354*a* are positioned the same plane to align with and couple to the electrical socket connectors 308*b* and 310*b*. The electrical pin connectors 352*b* and 354*b* are spaced apart from the electrical pin connectors 352*a* and 354*a* in the downhole direction 146. Electrical pin connectors 352*b* and 354*b* are positioned in the same plane to align with the electrical socket connectors 308*b* and 310*b* at the second location 322 of the axial docking station 302. Electrical pin connectors 352*c* and 354*c* are spaced apart from the electrical pin connectors 352*a* and 354*a*, and also spaced apart from electrical pin connectors 352*b* and 354*b*, in the downhole direction 146. Electrical pin connectors 352*c* and 354*c* are positioned in the same plane 328 to align with and couple to the electrical socket connectors 308*a* and 310*b* at the third location 330 of the axial docking station 302.

The electrical pin connectors 352*a-c* and the electrical pin connectors 354*a-c* are arranged on top of one another with similar radial orientation to one another in the uphole direction 148 and the downhole direction 146. In this implementation, the electrical pin connectors 352*a-c* and the electrical pin connectors 354*a-c* are vertically aligned to a tolerance of less than 0.5 degrees to ensure proper sealing to the axial docking station 302.

The axial downhole electrical connector selector 304 has an uphole end 356. The uphole end 356. The uphole end 356 is configured to couple to a downhole conveyance and the electrical submersible pump assembly 130. The downhole conveyance can be a coiled tubing assembly, a wireline assembly, a slickline assembly, a workover rig, a drilling rig, or any other suitable means of position components in the wellbore 102. The uphole end 356 can be a standard API (American Petroleum Institute) pin connection or a manufacturer proprietary design. For example, uphole end 356 can be any type of rotary shouldered connections such as box and pin connectors, regular connections, numeric connections, internal flush connections, or full hole connections. In other implementations, the uphole end 356 can be a box connection, where the threads are internal to the box. The uphole end 356 can be threaded to rotatably couple to the other components of the completion assembly 100 such as the electrical submersible pump assembly 130.

The axial downhole electrical connector selector 304 includes the rotational orienting feature 338. The rotational orienting feature 338 is configured to couple to the rotational orienting pin 332 of the axial docking station 302 when the axial downhole electrical connector selector 304 has placed in the fixed portion 112 of the completion assembly 100 and positioned to couple to the axial docking station 302. The rotational orienting feature 338 has a cutout 358 defining a surface 360 extending inward from an outer surface 362 of the rotational orienting feature 338. The surface 360 is angled about the circumference of the rotational orienting feature 338 from a bottom end 364 closer to the electrical pin connectors 352*a-c* and the electrical pin connectors 354*a-c* to a uphole end 356 of the axial downhole electrical connector selector 304. The surface 360 of the axial downhole electrical connector selector 304 slides along the rotational orienting pin 332 as the axial downhole electrical connector selector 304 is moved in the downhole direction 146 causing the axial downhole electrical connector selector 304 to rotate and align the electrical pin connectors 352*a-c* and the electrical pin connectors 354*a-c* to the electrical socket connectors 308*a-c* and 310*a-c*.

The surface 360 has a first portion 366 and a second portion 368. The first portion 366 receives the rotational orienting pin 332 and can aid in imparting rotational motion to the axial downhole electrical connector selector 304. The second portion 368 extends from the first portion 366 to a stop 370. The stop 370 is perpendicular to the second portion 368. The stop 370 limits travel of the axial downhole electrical connector selector 304 in the downhole direction 146 by engaging the rotational orienting pin 332.

The axial downhole electrical connector selector 304 includes the orientation head 340. The orientation head 340 is angled to slide relative to the top surface 346 of the landing profile 334 as the axial downhole electrical connector selector 304 is moved in the downhole direction 146.

Figure 3A:
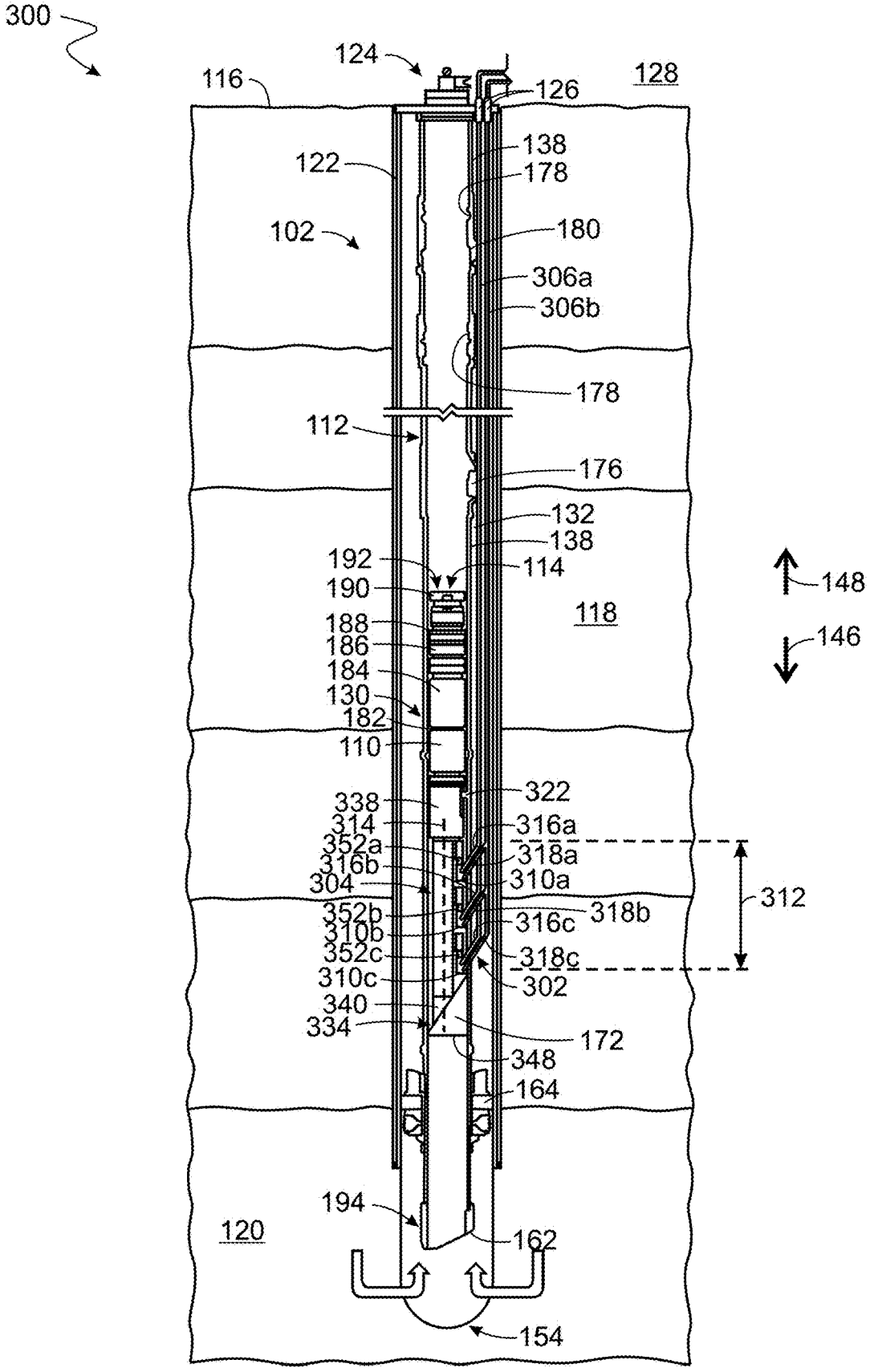
FIGS. 3A-3G show a second completion assembly having an axial docking station using an axial downhole electrical connector selector to transfer power from electrical cables to an electrical submersible pump assembly.
Figure 3B:
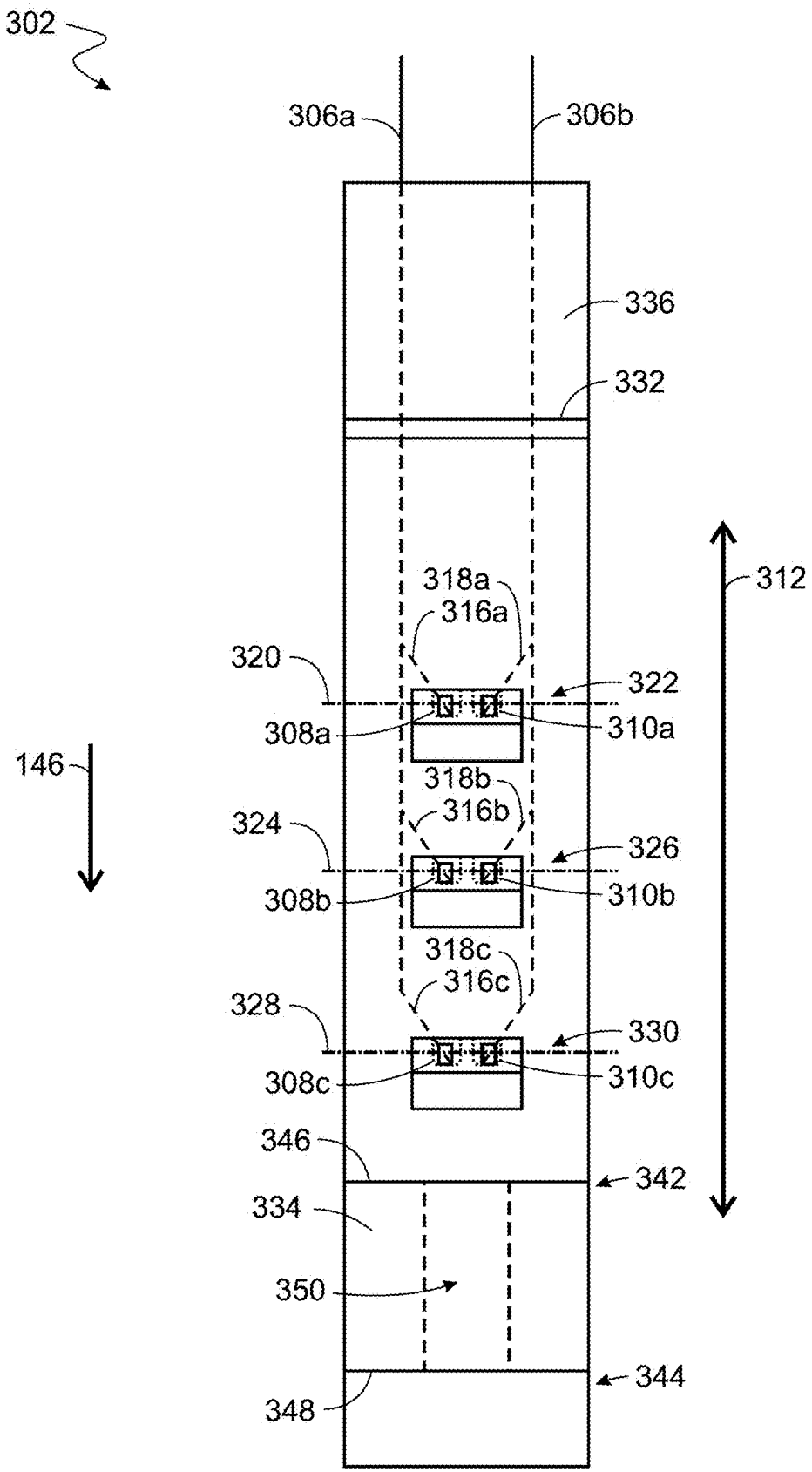
Figure 3C:
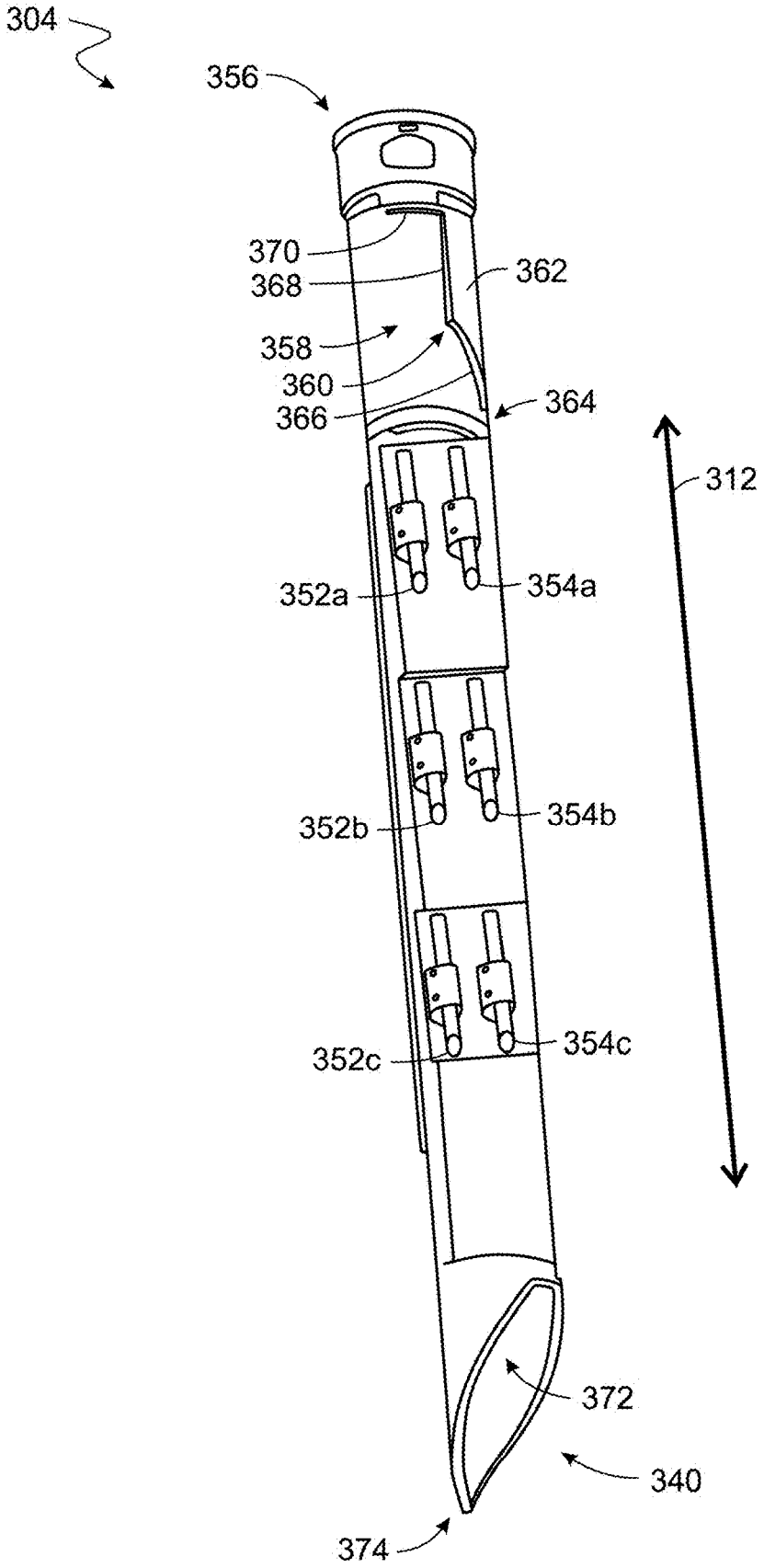

Referring to FIG. 3C, the axial downhole electrical connector selector 304 has a void 372. The void 372 extends through the axial downhole electrical connector selector 304 from a downhole end 374 to the uphole end 356. The void 372 allows the reservoir fluids to pass form the downhole end 374 to the uphole end 356 and into the electrical submersible pump assembly 130. The void 372 of the axial downhole electrical connector selector 304 aligns with the void of the 350 in the landing profile 334 to receive the reservoir fluids as the reservoir fluids pass through the axial docking station 302.

Figure 3D:
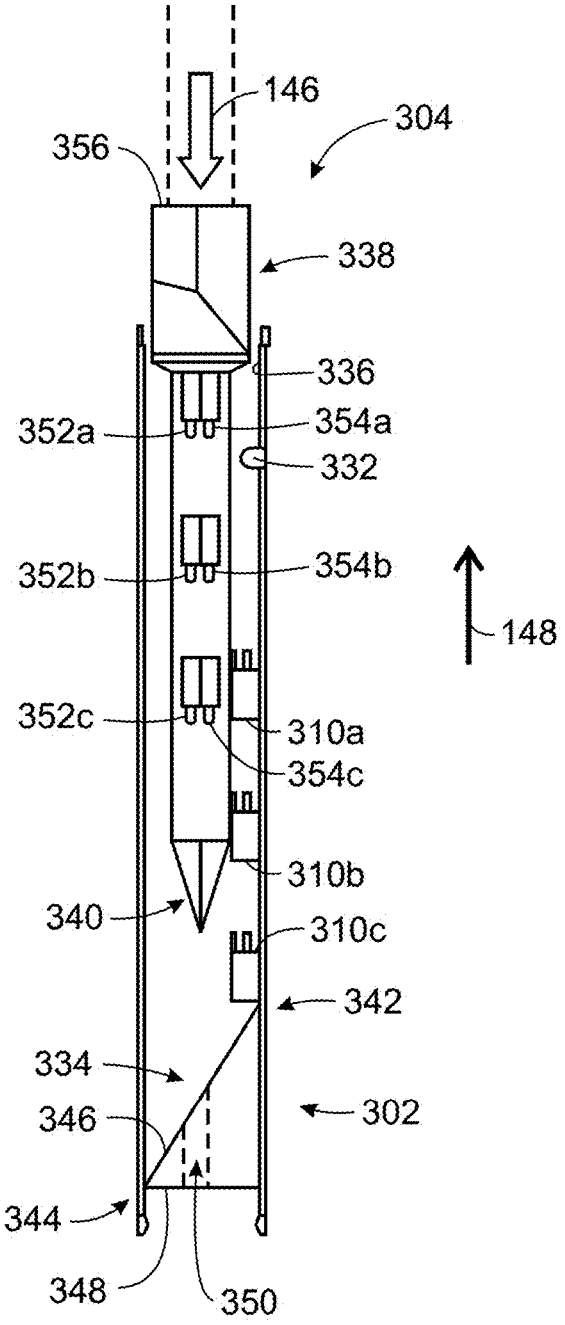
Figure 3E:
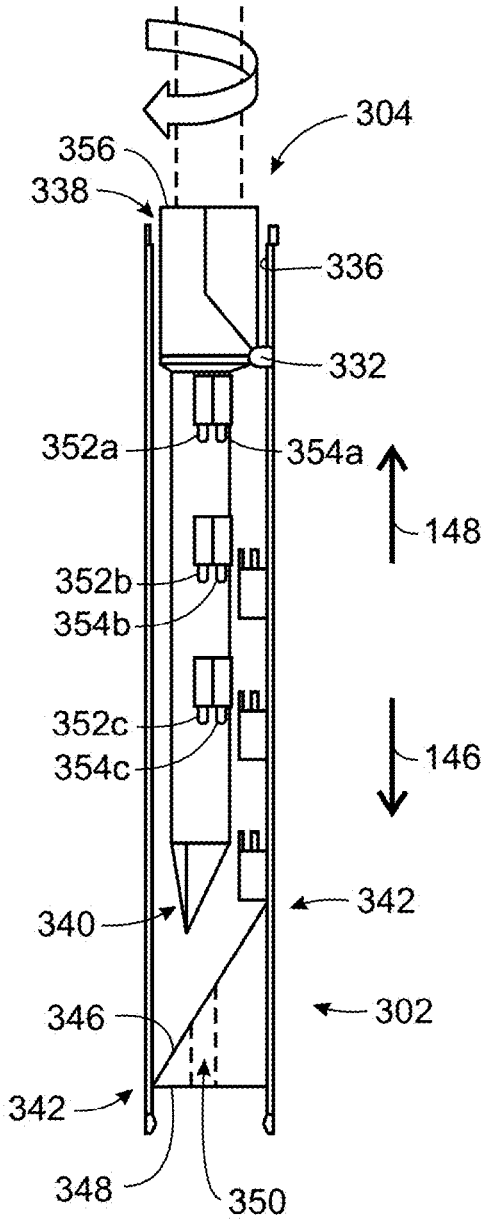
Figure 3F:
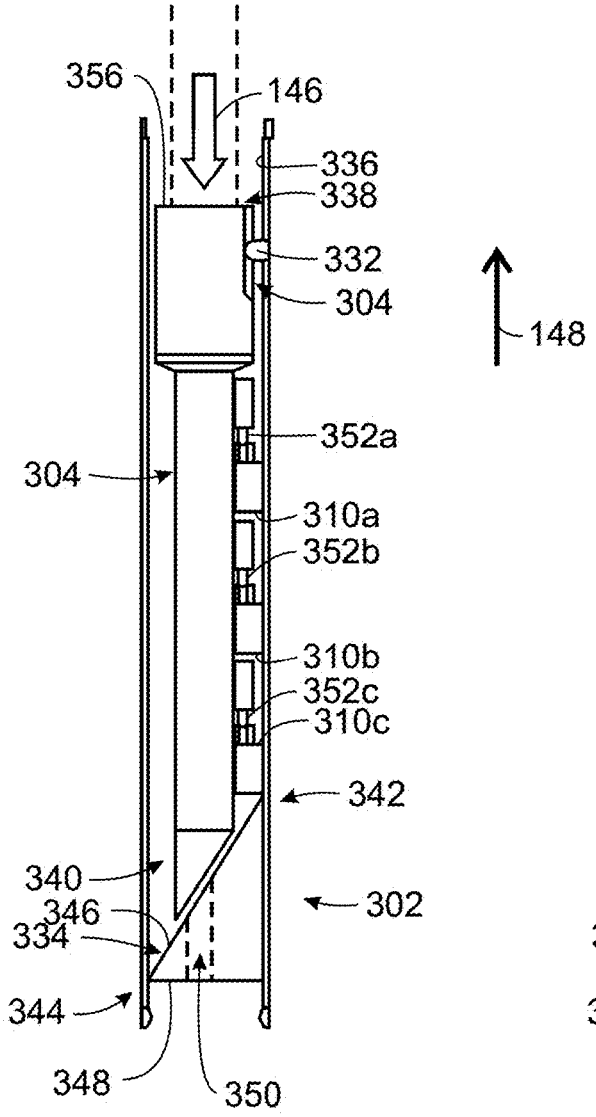

FIGS. 3D-3G illustrate coupling the axial downhole electrical connector selector 304 to the axial docking station 302. Referring to FIG. 3D, the downhole conveyance moves the axial downhole electrical connector selector 304 in the downhole direction 146 toward the axial docking station 302. In FIG. 3E, downhole conveyance continues to move the axial downhole electrical connector selector 304 in the downhole direction 146 until the rotational orienting feature 338 contacts the rotational orienting pin 332. The downhole conveyance rotates, assisted by the surface 360 sliding along the rotational orienting pin 332 in the clockwise direction. In FIG. 3F, the orienting pin 332 has reached the second portion 363 as the electrical pin connectors 352*a-c* and the electrical pin connectors 354*a-c* align axially to the electrical socket connectors 308*a-c* and 310*a-c*, but are still spaced from each other.

Figure 3G:
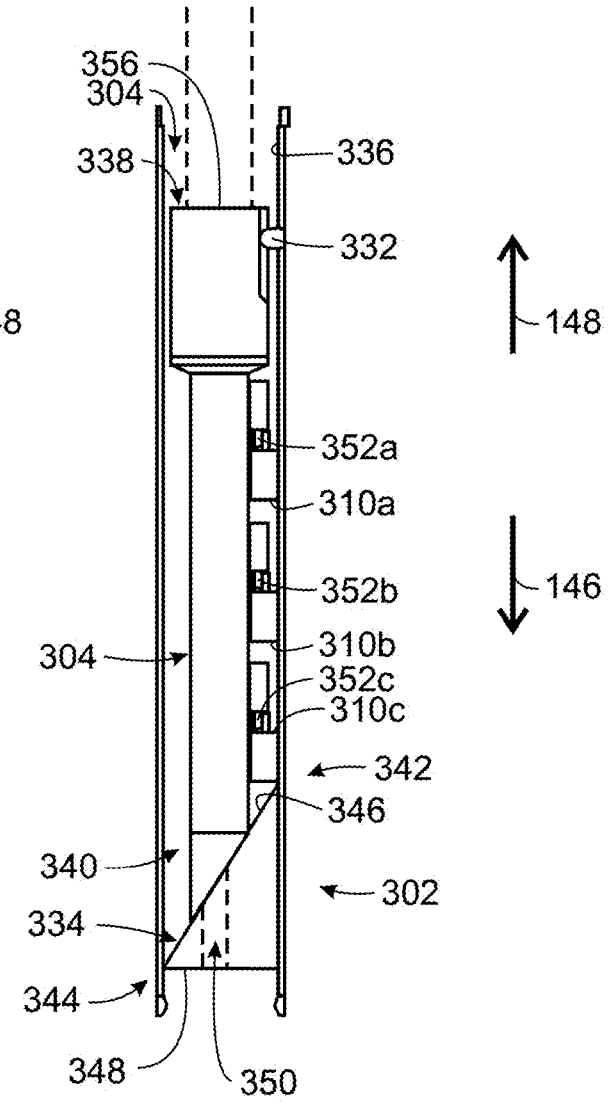

In FIG. 3G, the downhole conveyance moves the axial downhole electrical connector selector 304 to fully couple to the axial docking station 302. The second portion 368 of the surface 360 sides relative to the in rotational orienting pin 332 in the downhole direction 146 until the orienting pin 332 contacts the stop 370. Simultaneously, the electrical pin connectors 352*a-c* and the electrical pin connectors 354*a-c* fully contact the electrical socket connectors 308*a-c* and 310*a-c*. The orientation head 340 contacts the landing profile 334.

Referring to FIGS. 4A-4D, the electrical socket connectors 308*a-c* and electrical socket connectors 310*a-c* are in various configurations to transfer electricity from the electrical cables 306*a-b* to the electric motor 110. The electrical cable 306*a* is coupled to the electrical socket connectors 308*a-c*. The three phases 316*a-c* of the electrical cable 306*a* are coupled to the electrical socket connectors 308*a-c*. The electrical cable 306*b* is coupled to the electrical socket connectors 204*a-c*. The three phases 318*a-c* of the electrical cable 306*b* are coupled to the electrical connectors 210*a-c*. Once damage or failure resulting in a reduction or loss of electricity supplied to or through one or more of the electrical cables 306*a-b*, one or more of the phases 316*a-c* or 318*a-c*, or the electrical connectors 308*a-c* and electrical connectors 310*a-c* which are part of the fixed portion 112 of the completion assembly 300 is detected, the axial downhole electrical connector selector 304 can be removed from the wellbore 102, reconfigured to couple with another subset of non-failed electrical connectors 308*a-c* and electrical connectors 310*a-c*, and replaced in the wellbore 102 to couple the subset of still-functioning electrical connectors 208*a-c* and electrical connectors 210*a-c* to restore electricity flow to the electric motor 110 of the electrical submersible pump assembly 130.

Figures 4A, 4B:
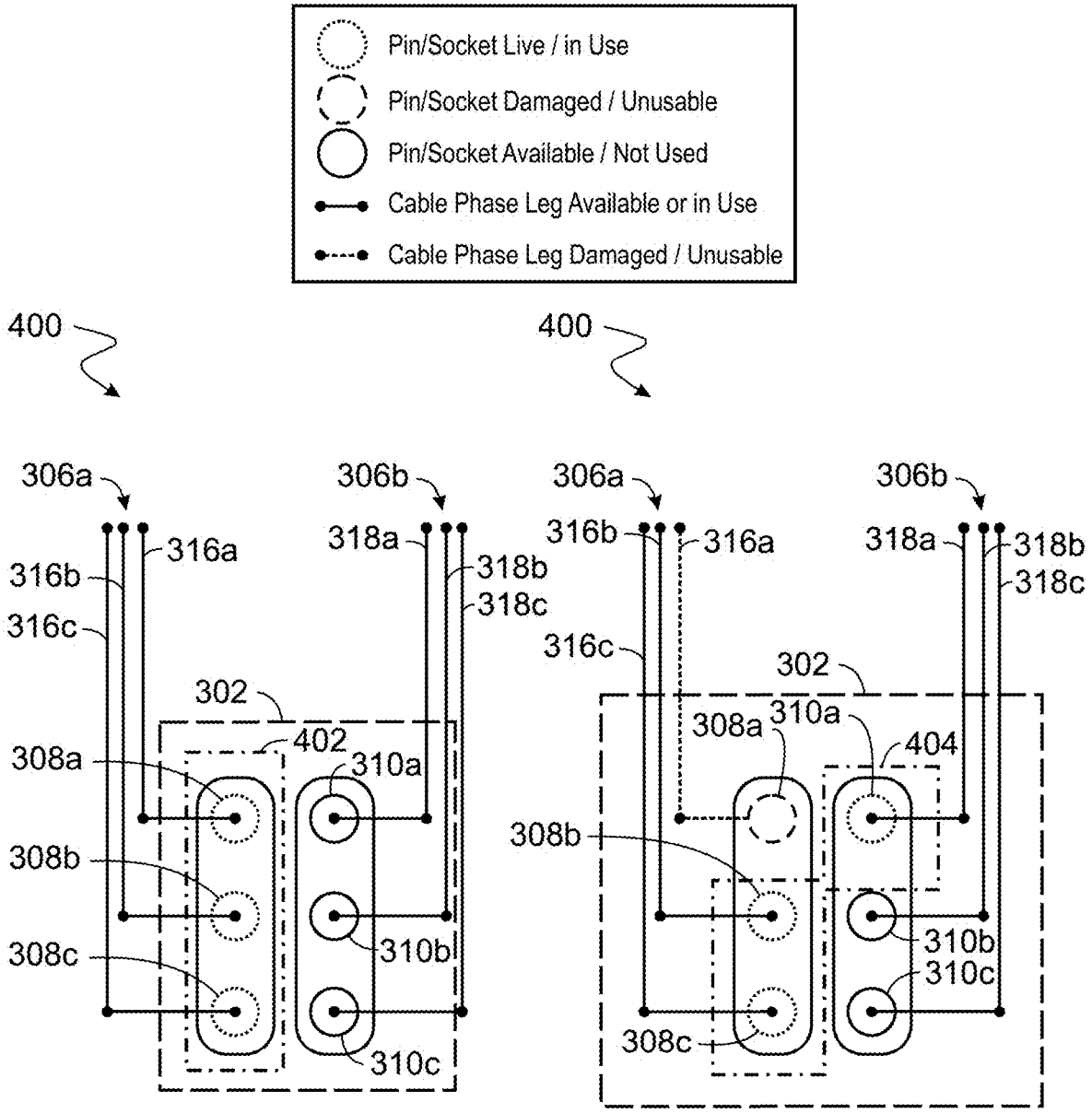
FIGS. 4A-4D show various configurations of the axial downhole electrical connecter selector of FIG. 3A.

FIGS. 4A-4D show four examples of operational permutations and fault tolerances. Referring to FIG. 4A, the axial downhole electrical connector selector 304 (not shown) is configured to receive electricity from the axial docking station 302 through the electrical connectors 308*a-c* which are powered by phases 316*a-c* of electrical cable 306*a*. Electrical connectors 308*a-c* and phases 316*a-c* of electrical cable 306*a* are capable of normal operation and conducting electricity to the axial docking station 302. Electricity is flowing from all three phases 216*a-c* of electrical cable 306*a* to each of the respective electrical connectors 308*a-c*. The electricity continues to flow from each of the electrical connectors 308*a-c* into the axial downhole electrical connector selector 304 and on to the electrical motor 110 of the electrical submersible pump assembly 130.

Electrical connectors 310*a-c* and phases 318*a-c* of electrical cable 306*b* are capable of normal operation and capable of flowing electricity to the axial docking station 302, however the axial downhole electrical connector selector 304 is not configured to receive and transfer electricity from electrical connectors 310*a-c* and phases 306*a-c* of electrical cable 306*b* to the electrical motor 110 of the electrical submersible pump assembly 130. Even though the electrical pin connectors 354*a-c* are coupled to the electrical socket connectors 310*a-c*, since the axial downhole electrical selector 304 is not configured to receive electricity from electrical socket connectors 310*a-c*, electrical socket connectors 310*a-c* do not pass electricity into the axial downhole electrical selector 304.

In the configuration shown in FIG. 4A, the electrical connectors 308*a-c* are a first subset 402 of all of the electrical socket connectors 308*a-c* and 310*a-c*. The first subset 402 (electrical socket connectors 308*a-c*) pass electricity to the axial downhole electrical connector selector 304. The axial downhole electrical connector selector 304 is configured to only receive electricity from the first subset 402 of electrical connectors 308*a-c*. The configuration of the axial downhole electrical connector selector 304 to receive and pass electricity form the first subset 402 to the electrical submersible pump assembly 130 can be referred to as an initial configuration, however, any configuration can be the initial configuration of the axial downhole electrical connector selector 304. In some implementations, the axial downhole electrical connector selector 304 can be initially configured to electrically couple to the electrical connectors 310*a-c* and electricity could flow from each of the three phases 318*a-c* through the electrical socket connectors 310*a-c* to power the electrical submersible pump assembly 130.

Referring to FIG. 4B, an electrical fault was detected in phase 316*a* of electrical cable 306*a* and/or electrical socket connector 308*a*. For example, an increase in resistance indicating an open or a decrease in resistance indicating a short can be detected. In some cases, corrosion or fluid ingress can occur into one or more of the electrical socket connectors 308*a-c* and 310*a-c* causing a short or reduced electrical capacity. When at least one of these indications has been detected, the removable portion 114 (at least the electrical submersible pump assembly 130 including the axial downhole electrical connector selector 304) is removed. The axial downhole electrical connector selector 304 is reconfigured to no longer couple to the electrical socket connector 308*a*. The axial downhole electrical connector selector 304 is reconfigured to couple to the electrical connector 310*a* instead of 202*a*, replacing that phase of the three phase electrical current. The axial downhole electrical connector selector 304 remains configured to electrically connect to the electrical socket connectors 308*b,c*. In this configuration, electrical socket connectors 308*b,c* supply two phases (phases 316*b,c*) of electrical power through electrical socket connectors 308*b,c* and one phase of electrical power through electrical socket connector 310*a* to the electrical motor 110, maintaining a supply of electricity to the electrical submersible pump assembly 130.

In the configuration shown in FIG. 4B, the electrical socket connectors 308*b,c* and 310*a* are a second subset 404 of all of the electrical socket connectors 308*a-c* and 310*a-c*. The second subset 404 (electrical socket connectors 308*b,c* and 310*a*) pass electricity to the axial downhole electrical connector selector 304. The axial downhole electrical connector selector 304 is configured to only receive electricity from the second subset 404 (electrical socket connectors 308*b,c* and 310*a*). In FIG. 4B, electrical socket connectors 310*b,c* are still functional and capable of transferring electricity, however, the axial downhole electrical selector 304 is not configured to electrically couple to electrical socket connectors 310*b,c*.

Figures 4C, 4D:
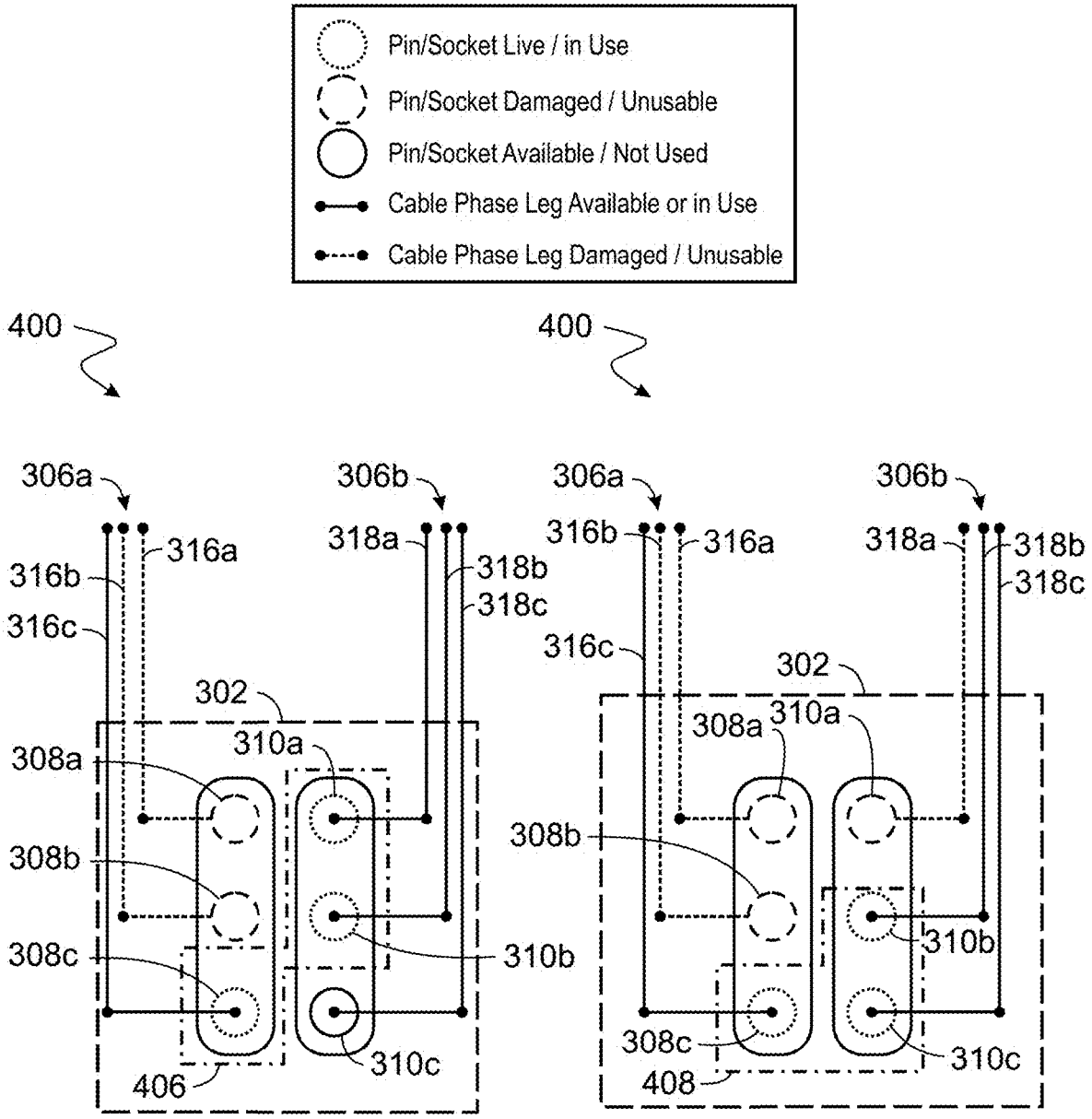

Referring to FIG. 4C, a subsequent electrical fault was detected in phase 316*b* of electrical cable 306*a* and/or electrical socket connector 308*b*. When at least one of these additional indications has been detected, the removable portion 114 (at least the electrical submersible pump assembly 130 including the axial downhole electrical connector selector 304) can be once again removed from the wellbore 102. The axial downhole electrical connector selector 304 is again reconfigured, but this time is reconfigured to no longer couple to the electrical socket connector 308*a* and 308*b*. The axial downhole electrical connector selector 304 is reconfigured to couple to the electrical socket connector 310*b* instead of electrical socket connector 308*b*, replacing that phase of the three phase electrical current. The axial downhole electrical connector selector 304 remains configured to electrically connect to the electrical socket connectors 308*c*. In this configuration, the electrical socket connectors 308*c* supplies one phase (phases 316*c*) of electrical power through electrical socket connectors 308*c* and two phases of electrical power through electrical socket connector 310*a,b* to the electrical motor 110, maintaining a supply of electricity to the electrical submersible pump assembly 130.

In the configuration shown in FIG. 4C, the electrical socket connectors 308*c* and 310*a,b* are a third subset 406 of all of the electrical socket connectors 308*a-c* and 310*a-c*. The third subset 406 (electrical socket connectors 308*c* and 310*a,b*) pass electricity to the axial downhole electrical connector selector 304. The axial downhole electrical connector selector 304 is configured to only receive electricity from the third subset 406 (electrical socket connectors 308*c* and 310*a,b*). In FIG. 4C, electrical connector 310*c* is still functional and capable of transferring electricity, however, the axial downhole electrical selector 304 is not configured to electrically couple to electrical socket connector 310*c*.

Referring to FIG. 4D, yet another subsequent electrical fault was detected in phase 318*a* of electrical cable 306*b* and/or electrical socket connector 310*a*. When at least one of these additional indications has been detected, the removable portion 114 (at least the electrical submersible pump assembly 130 including the axial downhole electrical connector selector 304) can be once again removed from the wellbore 102. The axial downhole electrical connector selector 304 is yet again reconfigured, but this time is reconfigured to no longer couple to the electrical socket connector 308*a,b* and 310*a*. The axial downhole electrical connector selector 304 is reconfigured to couple to the electrical socket connector 308*c* instead of 310*a*, replacing that phase of the three phase electrical current. The axial downhole electrical connector selector 304 remains configured to electrically connect to the electrical socket connector 308*c*. In this configuration, the electrical socket connector 308*c* supplies one phase (phases 316*c*) of electrical power through electrical socket connector 308*c* and two phases of electrical power through electrical socket connector 310*b,c* to the electrical motor 110, maintaining a supply of electricity to the electrical submersible pump assembly 130.

In the configuration shown in FIG. 4D, the electrical socket connectors 308*c* and 310*b,c* are a fourth subset 408 of all of the electrical socket connectors 308*a-c* and 310*a-c*. The fourth subset 408 (electrical socket connectors 308*c* and 310*b,c*) passes electricity to the axial downhole electrical connector selector 304. The axial downhole electrical connector selector 304 is configured to only receive electricity from the fourth subset 408 (electrical socket connectors 308*c* and 310*b,c*).

Although the electrical socket connectors 308*a-c* and 310*a-c* have been described as generally failing sequentially, they may fail in any order, and the axial downhole electrical connector selector 304 may be reconfigured in any desired order to maintain the flow of electricity from the functioning electrical socket connectors 308*a-c* and 310*a-c* using any desired combination of electrical socket connectors 308*a-c* and 310*a-c* may be used as the operating subset of electrical socket connectors 308*a-c* and 310*a-c*. Likewise, the axial downhole electrical connector selector 304 has been described as being reconfigured only one electrical socket connector at a time, however, axial downhole electrical connector selector 304 may be reconfigured to couple to two or three different electrical connectors, or even more when used, at the same time.

Figure 5:
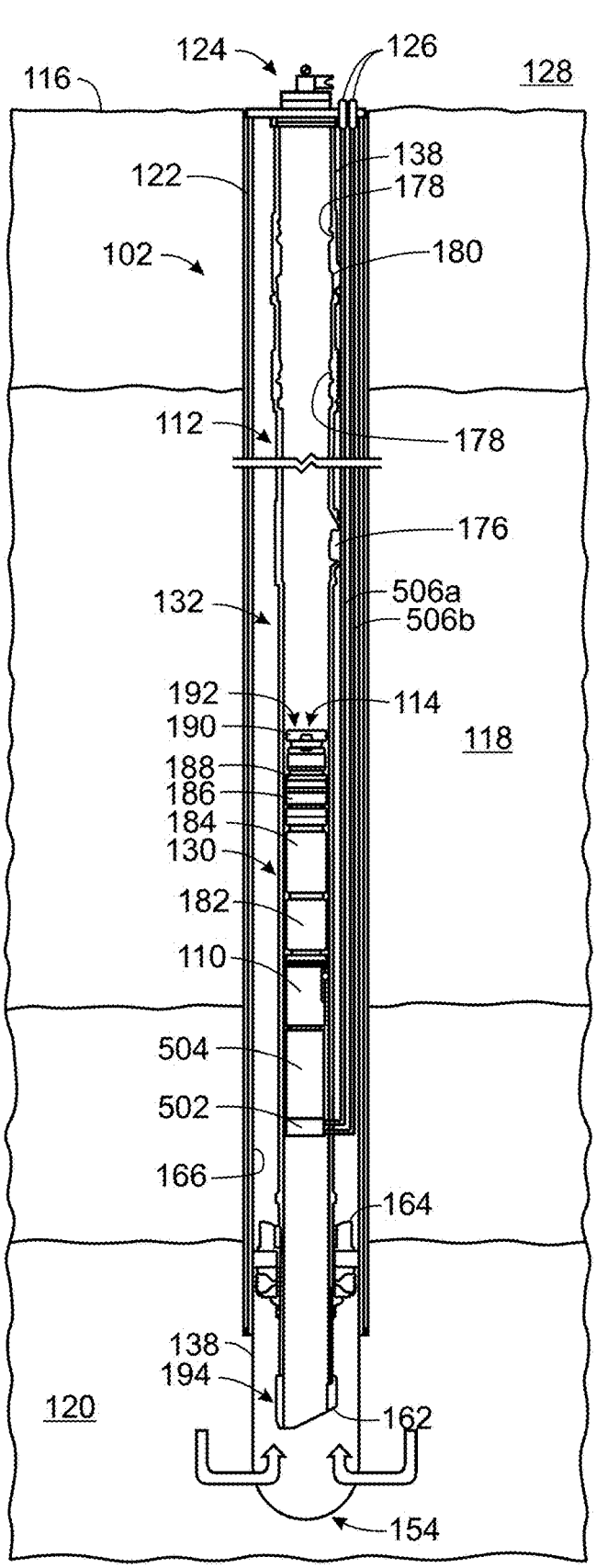
FIG. 5 shows another completion assembly having a radial docking station and a radial downhole electrical selector.

FIG. 5 show another completion assembly 500 having a radial docking station 502 and a radial downhole electrical selector 504. The radial docking station 502 and the radial downhole electrical selector 504 are coupled together to transfer power from electrical cables 506*a-b* to the electrical submersible pump assembly 130. The radial docking station 502 and the radial downhole electrical selector 504 have electrical connectors such as pins and sockets arranged radial about the respective bore. FIGS. 6-9, illustrate some embodiments of radial docking station 502 and radial downhole electrical selectors 504.

Figure 6:
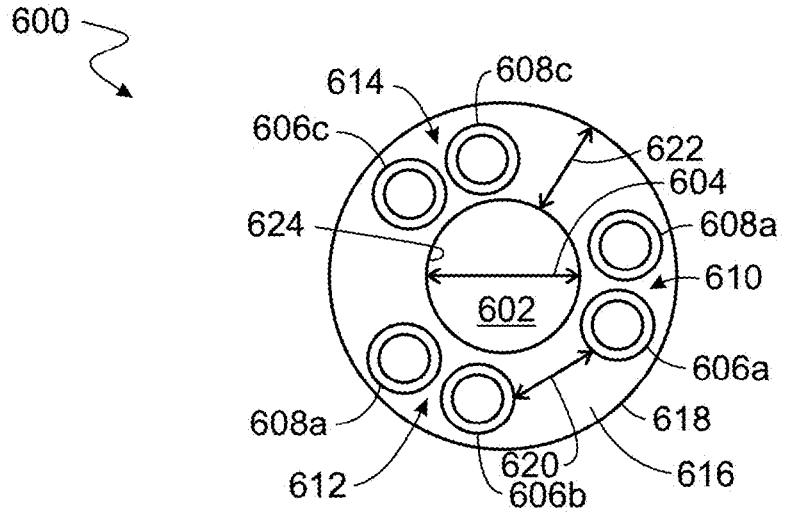
FIG. 6 shows a first radial downhole electrical selector of FIG. 5.

FIG. 6 shows a first radial downhole electrical connector selector 600 of the radial downhole electrical selector 504 shown in FIG. 5. The first radial downhole electrical connector selector 600 is a wet mate connector female type connection. Referring to FIGS. 1, 5, and 6, the first radial downhole electrical connector selector 600 is configured to couple to a corresponding male radial docking station 502. The radial docking station 502 is positioned in the fixed portion 112 of the completion assembly 500 and configured to receive and seal with the first radial downhole electrical connector selector 600. The electrical cables 506*a-b* extend from the surface 116 of the Earth to the radial docking station 502. The radial docking station 502 has electrical pin connectors (i.e., male type) configured to engage the first radial downhole electrical connector selector 600. The electrical pin connectors of the radial docking station 502 are coupled to each of the three phases of the electrical cables 506*a-b*.

Referring to FIGS. 5 and 6, the first radial downhole electrical selector 600 has a center bore 602 in the body 616 of the first radial downhole electrical connector selector 600. The center bore 602 mates with a center bore of the radial docking station 502. The center bore of the radial docking station 502 allows reservoir fluids to pass through the radial docking station 502 from a location downhole of the radial docking station 502 to the center bore of the first radial downhole electrical connector selector 600. The center bore 602 of the first radial downhole electrical connector selector 600 passes the reservoir fluid received from the radial docking station 502 to the electrical submersible pump assembly 130. The center bore 602 has a circular cross section defined by a diameter 604.

The body 616 of the first radial downhole electrical selector 600 has a uniform thickness 622. The thickness 622 extends from an outer surface 618 of the body 616 to an inner surface 624. The diameter 604 of the center bore 602 defines the inner surface 624 (i.e., a circumference of the center bore 602).

The first radial downhole electrical selector 600 has electrical socket connectors 606*a-c* and 608*a-c*. The electrical socket connectors 606*a-c* and 608*a-c* are configured to couple to and seal with the electrical pin connectors of the radial docking station 502. The electrical socket connectors 606*a-c* receive electricity from the electrical cable 506*a* through some of the electrical pin connectors of the radial docking station 502 and the electrical socket connectors 606*a-c* receive electricity from the electrical cable 506*b* through other electrical pin connectors of the radial docking station 502. The electrical socket connectors 606*a-c* and

608*a-c* transfer electricity received from the radial docking station 502 to the electrical submersible pump assembly 130. The first radial downhole electrical connector selector 600 is configurable and easily reconfigurable on the surface 116 to transfer electricity from a subset of the electrical socket connectors 606*a-c* and 608*a-c* to the electrical submersible pump assembly 130 as described in more detail in reference to FIGS. 10A-10D.

The electrical socket connectors 606*a-c* and 608*a-c* are arranged in pairs radially about the center bore 602. Electrical socket connectors 606*a* and 608*a* are a first pair 610. Electrical socket connectors 606*b* and 608*b* are a second pair 612. Electrical socket connectors 606*c* and 608*c* are a third pair 614. Each of the pairs 610, 612, and 614 are spaced apart from the other pairs in the body 616 of the first radial downhole electrical connector selector 600 by a distance 620. As shown in FIG. 6, the distance 620 between each pair 610, 612, 614 is generally uniform. However, in other implementations, the distance between each pair 610, 612, 614 can be different. The electrical socket connectors 606*a-c* and 608*a-c* are in the same horizontal plane.

Figure 7:
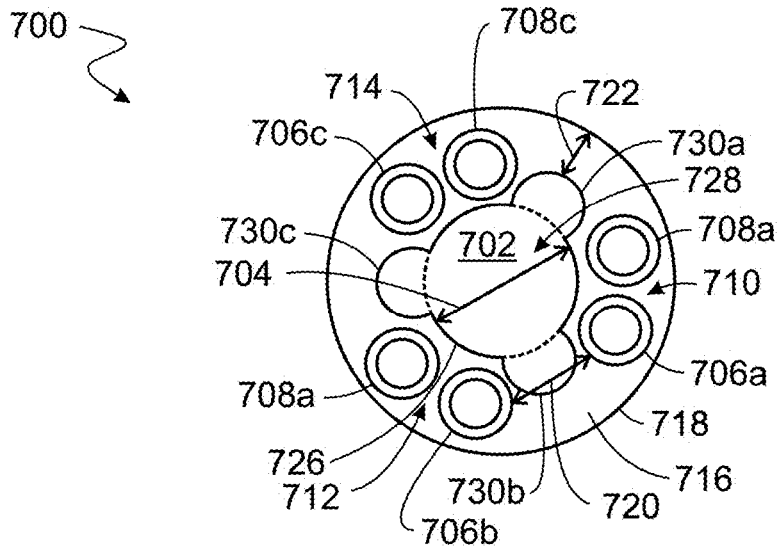
FIG. 7 shows a second radial downhole electrical selector of FIG. 5.

FIG. 7 shows a second radial downhole electrical connector selector 700 of the radial downhole electrical selector 504 shown FIG. 5. The second radial downhole electrical connector selector 700 is a wet mate connector female type connection. Referring to FIGS. 1, 5, and 7, the second radial downhole electrical connector selector 700 is configured to couple to a corresponding male radial docking station 502. The radial docking station 502 has electrical pin connectors (i.e., male type) configured to engage the first radial downhole electrical connector selector 700.

Referring to FIGS. 5 and 7, the second radial downhole electrical connector selector 700 has a body 716 with a center bore 702 in the body 716. The center bore 702 mates with a center bore of the radial docking station 502. The center bore of the radial docking station 502 allows reservoir fluids to pass through the radial docking station 502 from a location downhole of the radial docking station 502 to the center bore of the second radial downhole electrical connector selector 700. The center bore 702 of the second radial downhole electrical connector selector 700 passes the reservoir fluid received from the radial docking station 502 to the electrical submersible pump assembly 130. The center bore 702 has an irregular cross section. The irregular cross section can have a greater area than other implementations, allowing increased flow rates of reservoir fluids though the radial downhole electrical selector 700.

The irregular cross section 726 shown in FIG. 7 as a center portion 728. The center portion 726 has a circular cross section defined by a diameter 704. The irregular cross section 726 has three generally circular portions 730*a-c* extending from the center portion 728. Although the irregular cross section 726 has been shown and described as multiple overlapping circular cross sections, any suitable geometric or non-geometric shapes may be used.

The irregular cross section 726 can be eccentric to the main bore (center portion 728) and helical in shape to maximize the available flow area while maintaining the center portion 728 concentric bore for logging or intervention tools to pass through and access zones downhole from the second radial downhole electrical connector selector 700. In some implementations with a concentric circular design, the inner diameter 704 can be limited to one and one half inches to reduce the pressure loss and rate limitation flowing though the completion assembly 500 up to 4000-5000 barrels per day maximum.

The body 716 of the second radial downhole electrical selector 700 has a varying thickness 722. The thickness 622 extends from an outer surface 718 of the body 716 to an inner surface 724. The diameter 704 of the center bore 702 defines the inner surface 724 (i.e., a circumference of the center bore 702).

The second radial downhole electrical selector 700 has electrical socket connectors 706*a-c* and 708*a-c*. The electrical socket connectors 706*a-c* and 708*a-c* are configured to couple to and seal with the electrical pin connectors of the radial docking station 502. The electrical socket connectors 706*a-c* receive electricity from the electrical cable 506*a* through some of the electrical pin connectors of the radial docking station 502 and the electrical socket connectors 706*a-c* receive electricity from the electrical cable 506*b* through other electrical pin connectors of the radial docking station 502. The electrical socket connectors 706*a-c* and 708*a-c* transfer electricity from received from the radial docking station 502 to the electrical submersible pump assembly 130. The second radial downhole electrical connector selector 700 is configurable and easily reconfigurable on the surface 116 to transfer electricity from a subset of the electrical socket connectors 706*a-c* and 708*a-c* to the electrical submersible pump assembly 130 as described in more detail in reference to FIGS. 10A-10D.

The electrical socket connectors 706*a-c* and 708*a-c* are arranged in pairs radially about the center bore 702. Electrical socket connectors 706*a* and 708*a* are a first pair 710. Electrical socket connectors 706*b* and 708*b* are a second pair 712. Electrical socket connectors 706*c* and 708*c* are a third pair 714. Each of the pairs 710, 712, and 714 are spaced apart from the other pairs in the body 716 of the first radial downhole electrical connector selector 700 by a distance 720. As shown in FIG. 7, the distance 720 between each pair 710, 712, 714 is generally uniform. However, in other implementations, the distance between each pair 710, 712, 714 can be different. The electrical socket connectors 706*a-c* and 708*a-c* are in the same horizontal plane. The first pair 710 and the second pair 712 are separated by the generally circular portion 730*b* of the irregular cross section 726. The second pair 712 and the third pair 714 are separated by the generally circular portion 730*c* of the irregular cross section 726. The third pair 714 and the first pair 710 are separated by the generally circular portion 730*a* of the irregular cross section 726. The electrical socket connectors 706*a-c* and 708*a-c* are sized such that an additional number of pins (for example, one to four, or even more, pins) can be added. In some implementations, the electrical socket connectors 706*a-c* and 708*a-c* have a nominal diameter of half an inch, however the electrical socket connectors 706*a-c* and 708*a-c* can have any suitable diameter or length.

Figure 8:
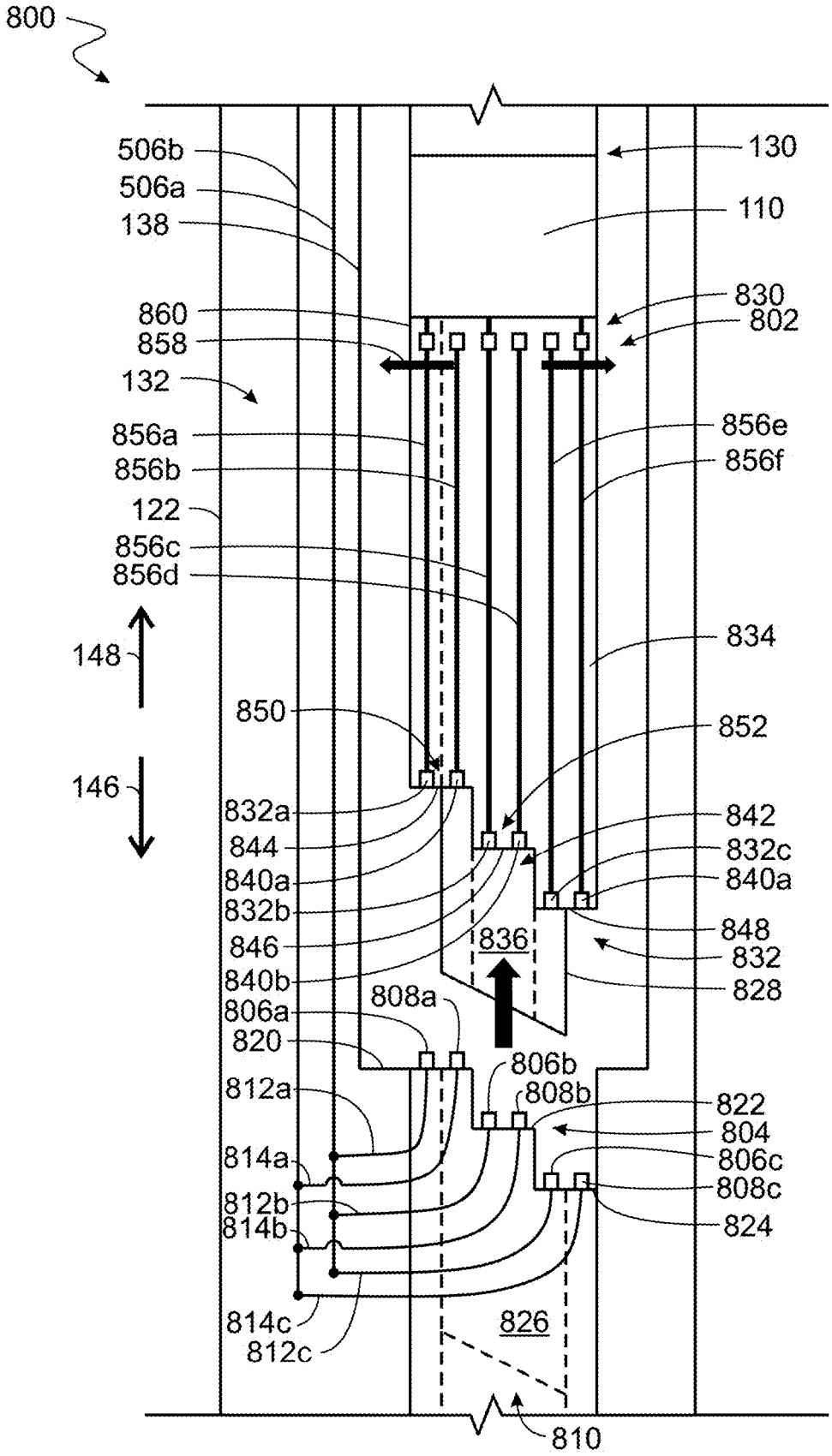
FIG. 8 shows a third radial downhole electrical selector and another radial docking station of FIG. 5.

FIG. 8 shows a third radial downhole electrical connector selector 802 and another radial docking station 804 of FIG. 5. The third radial downhole electrical connector selector 802 and another radial docking station 804 have electrical connectors spaced radial at different axial heights. Referring to FIGS. 1, 5, and 8, the radial docking station 804 is mechanically and electrically coupled to the electrical cables 506*a-b*. The radial docking station 804 receives electricity from the electrical cables 506*a-b* and transfers the electricity to the third radial downhole electrical connector selector 802. The radial docking station 804 is positioned in the fixed portion 112 of the completion assembly 500 and configured to receive and seal with the third radial downhole electrical connector selector 804. The electrical cables 506*a-b* extend from the surface 116 of the Earth to the radial docking station 804.

The radial docking station 804 has electrical pin connectors (i.e., male type) 806*a-c* and 808*a-c* configured to engage the third radial downhole electrical connector selector 802. The electrical pin connectors 806*a-c* are coupled to the three phases 812*a-c* of electrical cable 506*a*. The electrical pin connectors 808*a-c* are coupled to the three phases 814*a-c* of electrical cable 506*b*.

The radial docking station 804 has a body 816. The body 816 has a top surface 818. The top surface 818 is oriented in the uphole direction 148 toward the third radial downhole electrical connector selector 802.

The top surface 818 is tiered. The top surface 818 has a first tier 820, a second tier 822, and a third tier 824. The first tier 820 is farther in the uphole direction 148 than the second tier 822 and the third tier 824. The second tier 822 is positioned between the first tier 820 and the third tier 824. The third tier 824 is the bottommost tier and is farthest in the downhole direction 146 than the first tier 820 and the second tier 822. The tiers 820, 822, and 824 are in different axial planes, that is, at different heights along the radial docking station 804.

The electrical pin connectors 806*a* and 808*a* extend from the top surface 818 of the first tier 820. The electrical pin connectors 806*b* and 808*b* extend from the top surface 818 of the second tier 822. The electrical pin connectors 806*c* and 808*c* extend from the top surface 818 of the second tier 822.

The radial docking station 804 has a center bore 810 extending through the body 816. The center bore 810 allows reservoir fluids to pass through the radial docking station 502 from a location downhole of the radial docking station 502 to the third radial downhole electrical connector selector 802. A portion 826 of the center bore 810 is configured to receive and mate to an extension 828 of the third radial downhole electrical connector selector 802.

The electrical pin connectors 806*a-c* and 808*a-c* are arranged radially about the center bore 810. For example, the electrical pin connectors 806*a-c* and 808*a-c* can be positioned in pairs as shown and described in FIG. 6 and FIG. 7.

The third radial downhole electrical connector selector 802 is configured to physically and electrically mate with the radial docking station 804. The third radial downhole electrical selector 802 has an uphole end 830 and a downhole end 832 opposite the downhole end 832. The uphole end 830 is coupled to the electric motor 110. The downhole end 832 is coupled to the radial docking station 804.

The third radial downhole electrical selector 802 has a body 834. A center bore 836 extends through the body 834. The center bore 836 mates with the center bore 810 of the radial docking station 804. The center bore 836 receives the reservoir fluids from the radial docking station 804. The center bore 836 allows reservoir fluids to pass through the third radial downhole electrical connector selector 802 from the downhole end 832 to the uphole end 830. The center bore 836 of the third radial downhole electrical connector selector 802 passes the reservoir fluid received from the radial docking station 804 to the electrical submersible pump assembly 130. The center bore 836 has a circular cross section, however, any other cross section may be used, such as the irregular cross section 726 shown and described in reference in FIG. 7.

The third radial downhole electrical connector selector 802 includes the extension 828. The extension 828 extends from the downhole end 832 and enters the portion 826. The extension 828 is angled to couple to the portion 826 of the radial docking station 804 to orient the third radial downhole electrical connector selector 802 relative to the radial docking station 804, allowing the electrical socket connectors 838*a-c* and 840*a-c* to mate with the electrical pin connectors 806*a-c* and 808*a-c*.

The third radial downhole electrical selector 802 has electrical socket connectors 838*a-c* and 840*a-c*. The electrical socket connectors 838*a-c* and 840*a-c* are configured to couple to and seal with the electrical pin connectors 806*a-c* and 808*a-c* of the radial docking station 804, respectively. The electrical socket connectors 838*a-c* and 840*a-c* receive electricity from the electrical pin connectors 806*a-c* and 808*a-c* of the radial docking station 502 The electrical socket connectors 838*a-c* and 840*a-c* transfer electricity received from the radial docking station 502 to the electrical submersible pump assembly 130. The third radial downhole electrical connector selector 802 is configurable and easily reconfigurable on the surface 116 to transfer electricity from a subset of electrical socket connectors 838*a-c* and 840*a-c* to the electrical submersible pump assembly 130 as described in more detail in reference to FIGS. 10A-10D.

The third radial downhole electrical selector 802 has a bottom surface 842 at the downhole end 832. The bottom surface 842 is oriented in the downhole direction 146 toward the radial docking station 804.

The bottom surface 842 of the third radial downhole electrical connector selector 802 is tiered to mate and seal with the tiered top surface 818 of the radial docking station 804. The bottom surface 842 has a first tier 844, a second tier 846, and a third tier 848. The first tier 844 is farther in the uphole direction 148 than the second tier 846 and the third tier 848. The second tier 846 is positioned between the first tier 844 and the third tier 848. The third tier 848 is the bottommost tier and is farthest in the downhole direction 146 than the first tier 844 and the second tier 846. The tiers 844, 846, and 848 are in different axial planes, that is, at different heights along the third radial downhole electrical connector selector 802.

The electrical socket connectors 838*a-c* and 840*a-c* are arranged in pairs radially about the center bore 836. Electrical socket connectors 838*a* and 840*a* are a first pair 850. Electrical socket connectors 838*b* and 840*b* are a second pair 852. Electrical socket connectors 638*c* and 640*c* are a third pair 854. Each of the pairs 850, 852, and 854 are spaced apart from the other pairs in the body 834 of the third radial downhole electrical connector selector 802.

The third radial downhole electrical selector 802 has insulated conductors 856*a-f*. The insulated conductors 856*a-f* are coupled to the electrical socket connectors 838*a-c* and 840*a-c* and extend from the electrical socket connectors 838*a-c* and 840*a-c* to the electric motor 110. The insulated conductors 856*a-f* conduct electricity from the electrical socket connectors 838*a-c* and 840*a-c* to the electric motor 110.

The third radial downhole electrical selector 802 has a flow crossover passage 858. The flow crossover passage 858 is fluidly coupled to the center bore 836. The flow crossover passage 858 extends from the center bore 836 to an outer surface 860 of the third radial downhole electrical connector selector 802. The flow crossover passage 858 conducts a portion of the reservoir fluids in the center bore 836 into the production tubing 138 bypassing the electrical socket connectors 838*a-c* and 840*a-c* for the electrical submersible pump assembly 130 and directing fluid flow from below, upwards to the annulus between the motor 110 and the tubing and then on to the pump intake.

Figure 9:
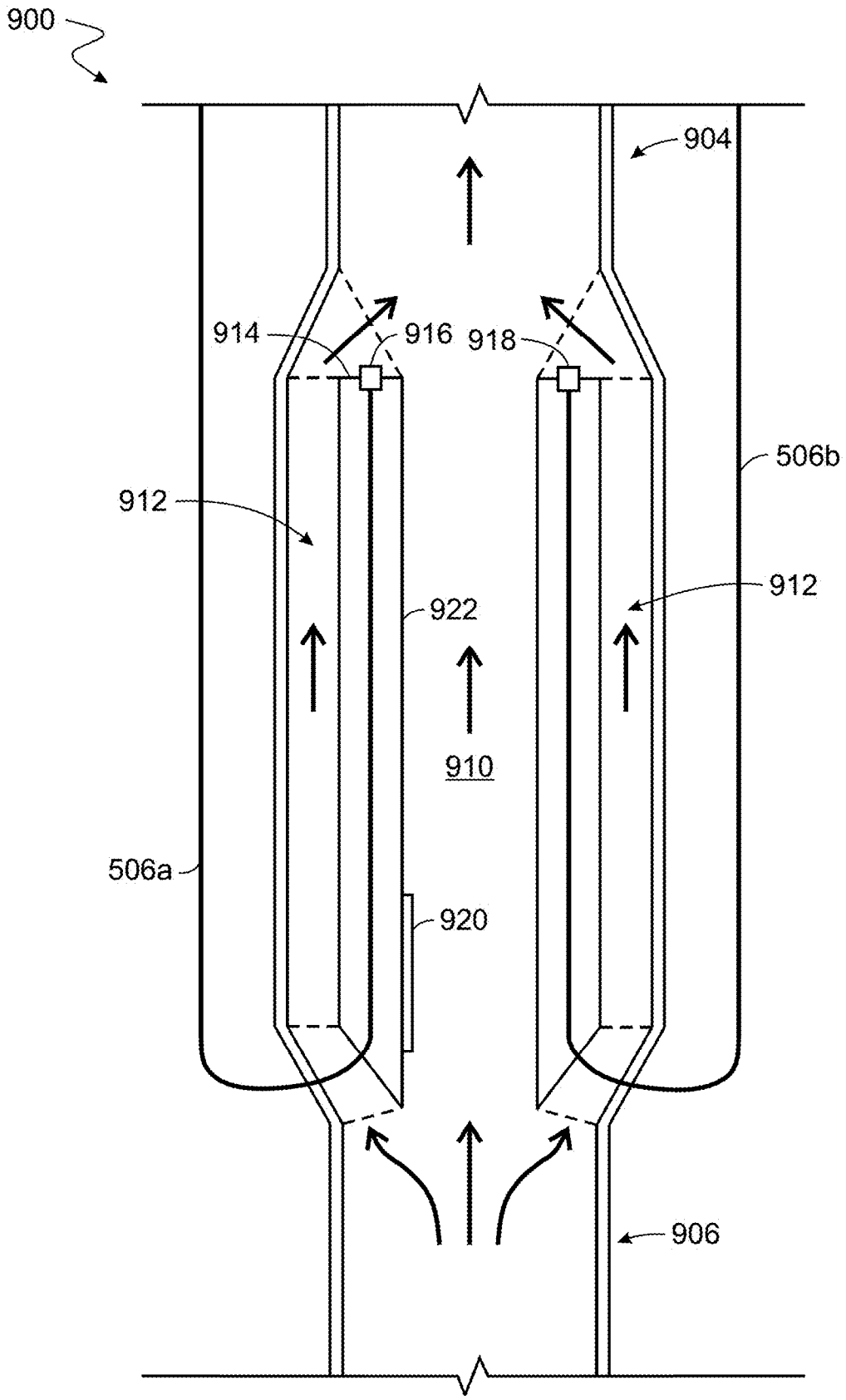
FIG. 9 shows another radial docking station of FIG. 5.

FIG. 9 shows another radial docking station 900 of FIG. 5. FIG. 9 is a cross section view of the radial docking station 900. The radial docking station 900 is configured to couple to radial downhole electrical selectors. For example, the radial docking station 900 can be configured to couple to the first radial downhole electrical connector selector 600 or the radial second radial downhole electrical connector selector 700.

The radial docking station 900 has a body 902. The body 902 has an uphole end 904 and a downhole end 906. The uphole end 904 is oriented toward the electrical submersible pump assembly 130. The downhole end 906 is oriented toward the bottom hole location 154.

The body 902 defines a center bore 910. The center bore 910 mates with the center bore 602 of the first radial downhole electrical connector selector 600 or the center bore 702 of the second radial downhole electrical connector selector 600. The center bore 910 of the radial docking station 900 allows reservoir fluids to pass through the radial docking station 900 from the downhole end 906 to the uphole end 904. The body 902 has a top surface 914.

The body 902 defines a flow bypass 912. The flow bypass 912 conducts a portion of the reservoir fluid passing through the radial docking station 900 away from and around the center bore 910. The flow bypass 912 can be ports which are drilled (i.e., round) or milled (i.e., non-round shapes such as kidney ports) through a split, sealed solid body. The flow bypass 912 has a design flow rate (i.e., fluid velocity). The design flow rate of the flow bypass 912 is selected so the flow velocity reduces or limit erosion.

The radial docking station 900 has an electrical pin connector 916 and another electrical pin connector 918. The electrical pin connector 916 and the electrical pin connector 918 are positioned on the top surface 914. Although only two electrical pin connectors are shown, the radial docking station 900 includes other electrical pin connectors, not shown, configured to mate with the first radial downhole electrical connector selector 600 or the radial second radial downhole electrical connector selector 700.

The radial docking station 900 has a landing orientation profile 920. The landing orientation profile 920 is positioned on an inner surface 922 of the center bore 910. The landing orientation profile 920 is configured to couple to a portion of one or more of the radial downhole electrical connector selectors 600, 700, or 802 to align and orient the respective electrical socket connectors to the electrical pin connectors 916 and 918.

FIGS. 10A-10D show various configurations of the radial docking station 502 of FIG. 5 and described in reference to FIGS. 5-9. Referring to FIGS. 5-10D, the electrical socket connectors 606*a-c* and 608*a-c* (as shown in FIG. 6), electrical socket connectors 706*a-c* and 708*a-c* (shown in FIG. 7), and 838*a-c* and 840*a-c* (shown in FIG. 8) are in various configurations to transfer electricity from the electrical cables 506*a-b* to the electric motor 110. Referring to FIG. 5 and FIG. 10, the radial docking station 502 has electrical pin connectors 1002*a-c* and 1004*a-c* configured to couple to the electrical socket connectors shown and described in FIGS. 6-8. The electrical pin connectors 1002*a-c* and 1004*a-c* are positioned radially about a center bore 1006 defined in the body 1008 of the radial docking station 502.

The electrical cable 506*a* is coupled to the electrical socket connectors 1002*a-c*. The three phases 1010*a-c* of the electrical cable 506*a* are coupled to the electrical pin connectors 1002*a-c*. The electrical cable 506*b* is coupled to the electrical pin connectors 1004*a-c*. The three phases 1012*a-c* of the electrical cable 506*b* are coupled to the electrical pin connectors 1004*a-c*. Once damage or failure resulting in a reduction or loss of electricity supplied to or through one or more of the electrical cables 506*a-b*, one or more of the phases 1010*a-c* or 1012*a-c*, or the electrical pin connectors 1002*a-c* and electrical pin connectors 1004*a-c* which are part of the fixed portion 112 of the completion assembly 500 is detected, the radial downhole electrical connector selector 600, 700, or 802 can be removed from the wellbore 102, reconfigured to couple with another subset of non-failed corresponding electrical socket connectors and electrical socket connectors, and replaced in the wellbore 102 to couple the subset of still-functioning electrical pin connectors 1002*a-c* and electrical connectors 1004*a-c* to restore electricity flow to the electric motor 110 of the electrical submersible pump assembly 130.

Figures 10A, 10B:
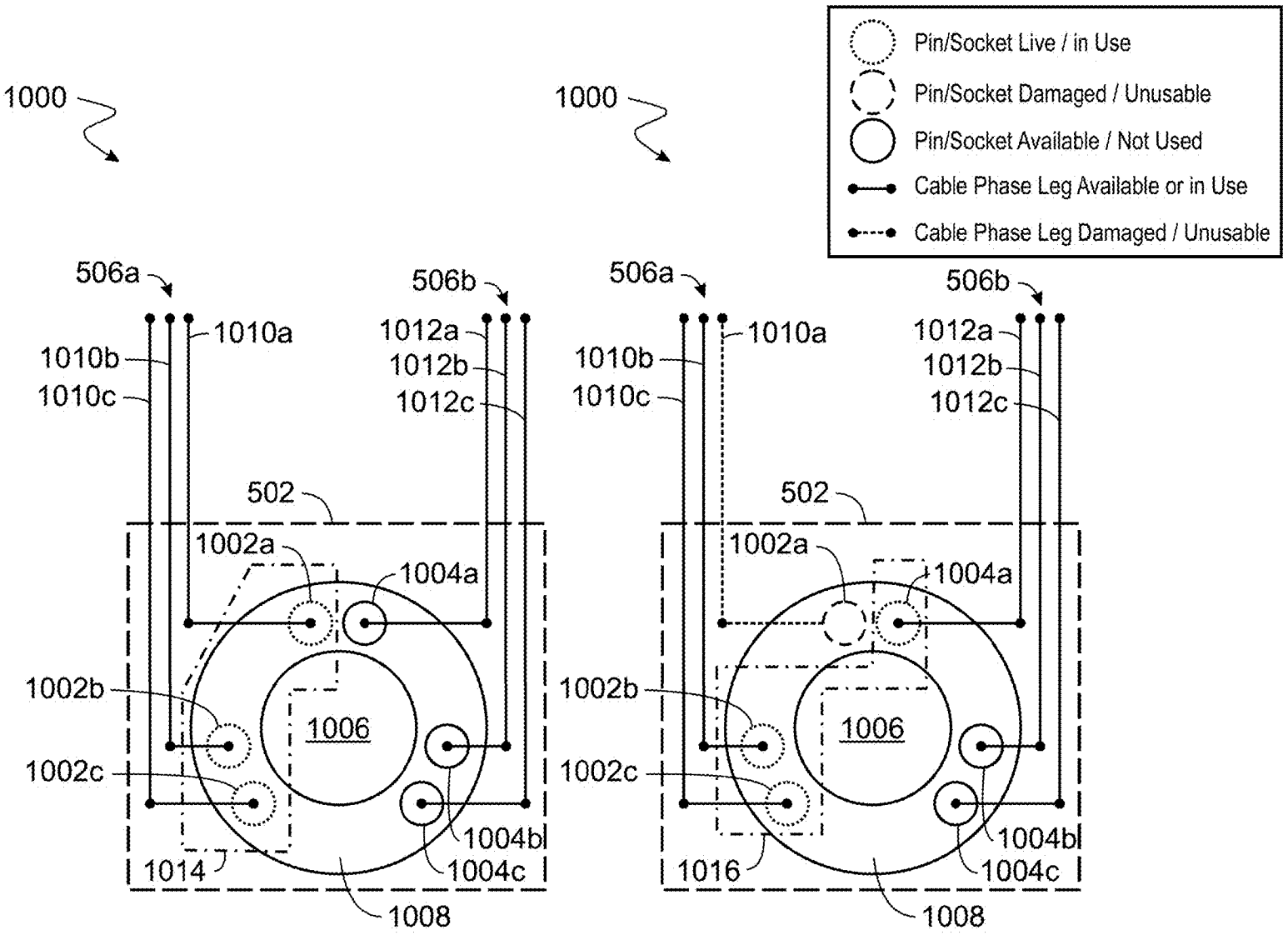
FIGS. 10A-10D show various configurations of the radial docking station of FIG. 5.

FIGS. 10A-10D show four examples of operational permutations and fault tolerances. Referring to FIG. 10A, the radial downhole electrical connector selector (600, 700, or 802, not shown) is configured to receive electricity from the radial docking station 502 through the electrical pin connectors 1002*a-c* which are powered by phases 1010*a-c* of electrical cable 506*a*. Electrical pin connectors 1002*a-c* and phases 1010*a-c* of electrical cable 506*a* are capable of normal operation and conducting electricity to the radial docking station 502. Electricity is flowing from all three phases 1010*a-c* of electrical cable 506*a* to each of the respective electrical connectors 1002*a-c*. The electricity continues to flow from each of the electrical pin connectors 1002*a-c* into the radial downhole electric connector selector 600, 700, or 802 and on to the electrical motor 110 of the electrical submersible pump assembly 130.

Electrical connectors 1006*a-c* and phases 1012*a-c* of electrical cable 506*b* are capable of normal operation to the radial docking station 502, however the radial downhole electric connector selector 600, 700, or 802 is not configured to receive and transfer electricity from electrical pin connectors 1006*a-c* and phases 1012*a-c* of electrical cable 506*b* to the electrical motor 110 of the electrical submersible pump assembly 130. Even though the electrical socket connectors of the radial downhole electrical connector selector 600, 700, or 802 are coupled to the electrical pin connectors 1006*a-c*, since the radial downhole electrical connector selector 600, 700, or 802 is not configured to receive electricity from electrical pin connectors 1004*a-c*, electrical pin connectors 1004*a-c* do not pass electricity into the radial downhole electrical connector selector 600, 700, or 802.

In the configuration shown in FIG. 10A, the electrical pin connectors 1102*a-c* are a first subset 1014 of all of the electrical pin connectors 1002*a-c* and 1004*a-c*. The first subset 1014 (electrical pin connectors 1002*a-c*) passes electricity to the radial downhole electric connector selector 600, 700, or 802. The radial downhole electric connector selector 600, 700, or 802 is configured to only receive electricity from the first subset 1014 (electrical pin connectors 1002*a-c*). The configuration of the radial downhole electrical connector selector 600, 700, or 802 to receive and pass electricity form the first subset 1014 to the electrical submersible pump assembly 130 can be referred to as an initial configuration, however, any configuration can be the initial configuration of the radial downhole electrical connector selector 600, 700, or 802. In some implementations, the radial downhole electrical connector selector 600, 700, or 802 can be initially configured to electrically couple to the electrical pin connectors 1006*a-c* and electricity could flow from each of the three phases 1012*a-c* through the electrical socket connectors 1006*a-c* to power the electrical submersible pump assembly 130.

Referring to FIG. 10B, an electrical fault was detected in phase 1010*a* of electrical cable 506*a* and/or electrical pin connector 1002*a*. For example, an increase in resistance indicating an open or a decrease in resistance indicating a short can be detected. In some cases, corrosion or fluid ingress can occur into one or more of the electrical pin connectors 1002*a-c* and 1004*a-c* causing a short or reduced electrical capacity. When at least one of these indications has been detected, the removable portion 114 (at least the electrical submersible pump assembly 130 including the radial downhole electrical connector selector 600, 700, or 802) is removed. The radial downhole electrical connector selector 600, 700, or 802 is reconfigured to no longer couple to the electrical pin connector 1002*a*. The radial downhole electrical connector selector 600, 700, or 802 is reconfigured to couple to the electrical pin connector 1006*a* instead of 1002*a*, replacing that phase of the three phase electrical current. The radial downhole electrical connector selector 600, 700, or 802 remains configured to electrically connect to the electrical pin connectors 1002*b,c*. In this configuration, electrical pin connectors 1002*b,c* supply two phases (phases 1010*b,c*) of electrical power through electrical pin connectors 1002*b,c* and one phase 1012*a* of electrical power through electrical pin connector 1004 to the electrical motor 110, maintaining a supply of electricity to the electrical submersible pump assembly 130.

In the configuration shown in FIG. 10B, the electrical pin connectors 1002*b,c* and 1004*a* are a second subset 1016 of all of the electrical pin connectors 1002*a-c* and 1004*a-c*. The second subset 1016 (electrical pin connectors 1002*b,c* and 1004*a*) passes electricity to the radial downhole electrical connector selector 600, 700, or 802. The radial downhole electrical connector selector 600, 700, or 802 is configured to only receive electricity from the second subset 1016 (electrical pin connectors 1002*b,c* and 1004*a*). In FIG. 10B, electrical pin connectors 1004*b,c* are still functional and capable of transferring electricity, however, the radial downhole electrical connector selector 600, 700, or 802 is not configured to electrically couple to electrical pin connectors 1004*b,c*.

Figures 10C, 10D:
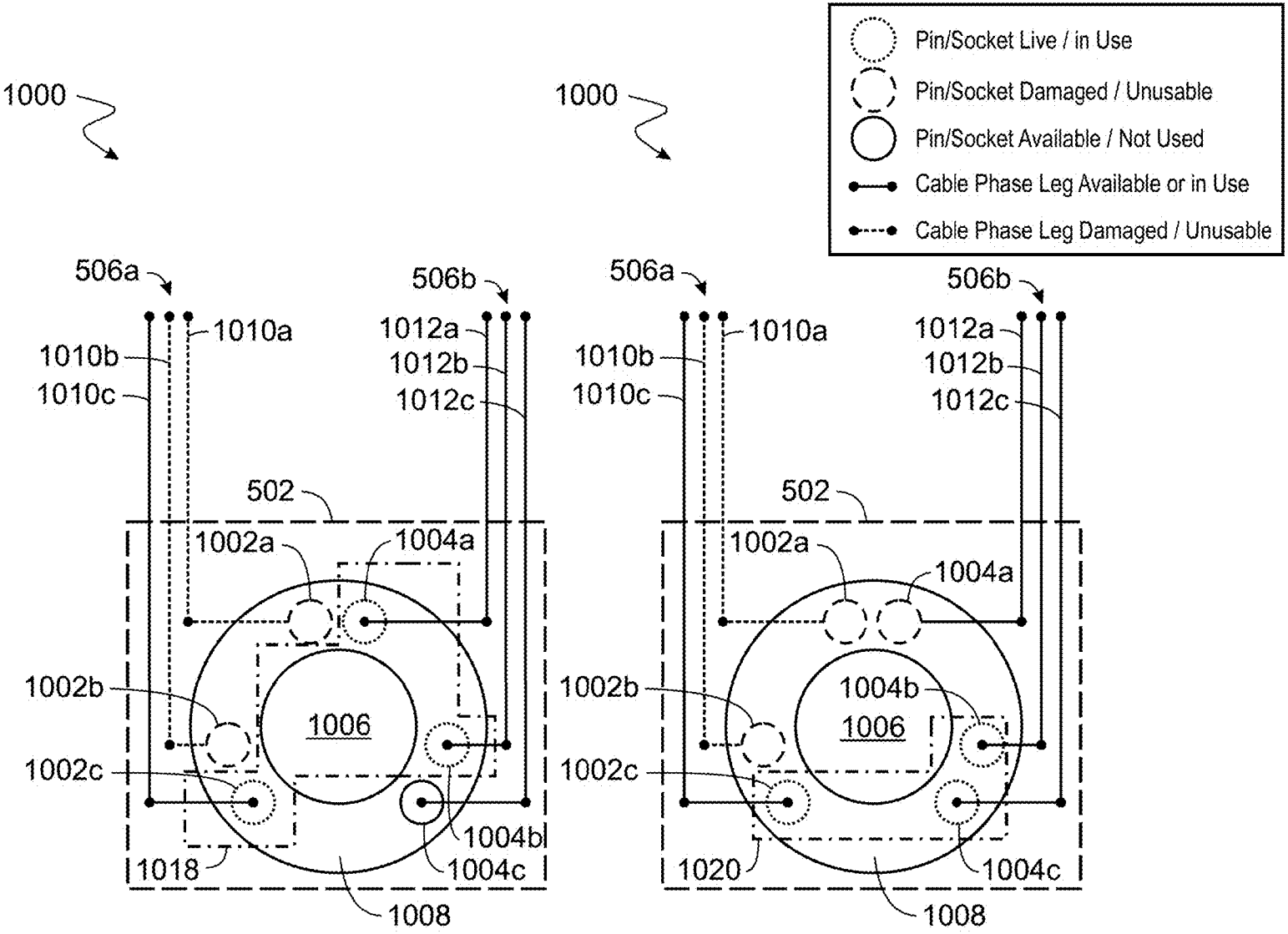

Referring to FIG. 10C, a subsequent electrical fault was detected in phase 1010*b* of electrical cable 506*a* and/or electrical pin connector 1002*b*. When at least one of these additional indications has been detected, the removable portion 114 (at least the electrical submersible pump assembly 130 including the radial downhole electrical connector selector 600, 700, or 802) can be once again removed from the wellbore 102. The radial downhole electrical connector selector 600, 700, or 802 is again reconfigured, but this time is reconfigured to no longer couple to the electrical pin connector 1002*a* and 1002*b*. The radial downhole electrical connector selector 600, 700, or 802 is reconfigured to couple to the electrical pin connector 1004*b* instead of electrical pin connector 1002*b*, replacing that phase of the three phase electrical current. The radial downhole electrical connector selector 600, 700, or 802 remains configured to electrically connect to the electrical pin connectors 1002*c*. In this configuration, the electrical pin connectors 1002*c* supplies one phase (phase 1010*c*) of electrical power through electrical pin connectors 1002*c* and two phases 1012*a-b* of electrical power through electrical pin connector 1004*a,b* to the electrical motor 110, maintaining a supply of electricity to the electrical submersible pump assembly 130.

In the configuration shown in FIG. 10C, the electrical pin connectors 1002*c* and 1004*a,b* are a third subset 1018 of all of the electrical pin connectors 1002*a-c* and 1004*a-c*. The third subset 1018 (electrical pin connectors 1002*c* and 1004*a,b*) pass electricity to the radial downhole electrical connector selector 600, 700, or 802. The radial downhole electrical connector selector 600, 700, or 802 is configured to only receive electricity from the third subset 1018 (electrical pin connectors 1002*c* and 1004*a,b*). In FIG. 10C, electrical pin connector 1004*c* is still functional and capable of transferring electricity, however, the radial downhole electrical connector selector 600, 700, or 802 is not configured to electrically couple to electrical pin connector 1004*c*.

Referring to FIG. 10D, yet another subsequent electrical fault was detected in phase 1012*a* of electrical cable 506*b* and/or electrical pin connector 1004*a*. When at least one of these additional indications has been detected, the removable portion 114 (at least the electrical submersible pump assembly 130 including the radial downhole electrical connector selector 600, 700, or 802) can be once again removed from the wellbore 102. The radial downhole electrical connector selector 600, 700, or 802 is yet again reconfigured, but this time is reconfigured to no longer couple to the electrical pin connector 1002*a,b* and 1004*a*. The radial downhole electrical connector selector 600, 700, or 802 is reconfigured to couple to the electrical pin connector 1004*c* instead of electrical pin connector 1004*a*, replacing phase 1012*a* of the three phase electrical current. The radial downhole electrical connector selector 600, 700, or 802 remains configured to electrically connect to the electrical pin connector 1002*c*. In this configuration, the electrical pin connector 1002*c* supplies one phase 1010*c* of electrical power through electrical pin connector 1002*c* and two phases 1012*b-c* of electrical power through electrical pin connector 1004*b,c* to the electrical motor 110, maintaining a supply of electricity to the electrical submersible pump assembly 130.

In the configuration shown in FIG. 10D, the electrical pin connectors 1002*c* and 1004*b,c* are a fourth subset 1020 of all of the electrical pin connectors 1002*a-c* and 1004*a-c*. The fourth subset 1020 (electrical pin connectors 1002*c* and 1004*b,c*) pass electricity to the radial downhole electrical connector selector 600, 700, or 802. The radial downhole electrical connector selector 600, 700, or 802 is configured to only receive electricity from the fourth subset 1020 (electrical pin connectors 1002*c* and 1004*b,c*).

Although the electrical pin connectors 1002*a-c* and 1004*a-c* have been described as generally failing sequentially, they may fail in any order, and the radial downhole electrical connector selector 600, 700, or 802 may be reconfigured in any desired order to maintain the flow of electricity from the functioning electrical pin connectors 1002*a-c* and 1004*a-c* using any desired combination of electrical pin connectors 1002*a-c* and 1004*a-c* may be used as the operating subset of electrical pin connectors 1002*a-c* and 1004*a-c*. Likewise, the radial downhole electrical connector selector 600, 700, or 802 has been described as one electrical socket connector being reconfigured at a time, however, two or three, or even more when used, electrical socket connectors may be reconfigured at the same time.

Each of the side pocket mandrel electrical connector selector 104, the axial downhole electrical connector selector 304, and the radial downhole electrical connector selectors 600, 700, and 802 include reconfigurable features and components to couple to the respective docking stations to selectively transfer electricity from the desired electrical connectors through the respective downhole electrical connector selector to the electric motor 110 of the electrical submersible pump assembly 130. For example, the respective downhole electrical connector selector 106, 304, 600, 700, and 802 can include a series of jumpers which an operator can access, reposition, and re-seal to alter the electrical transfer configuration. The jumpers are configured and tested prior to running at the surface 116, and can only be accessed and changed on surface 116 and not downhole.

Figure 11:
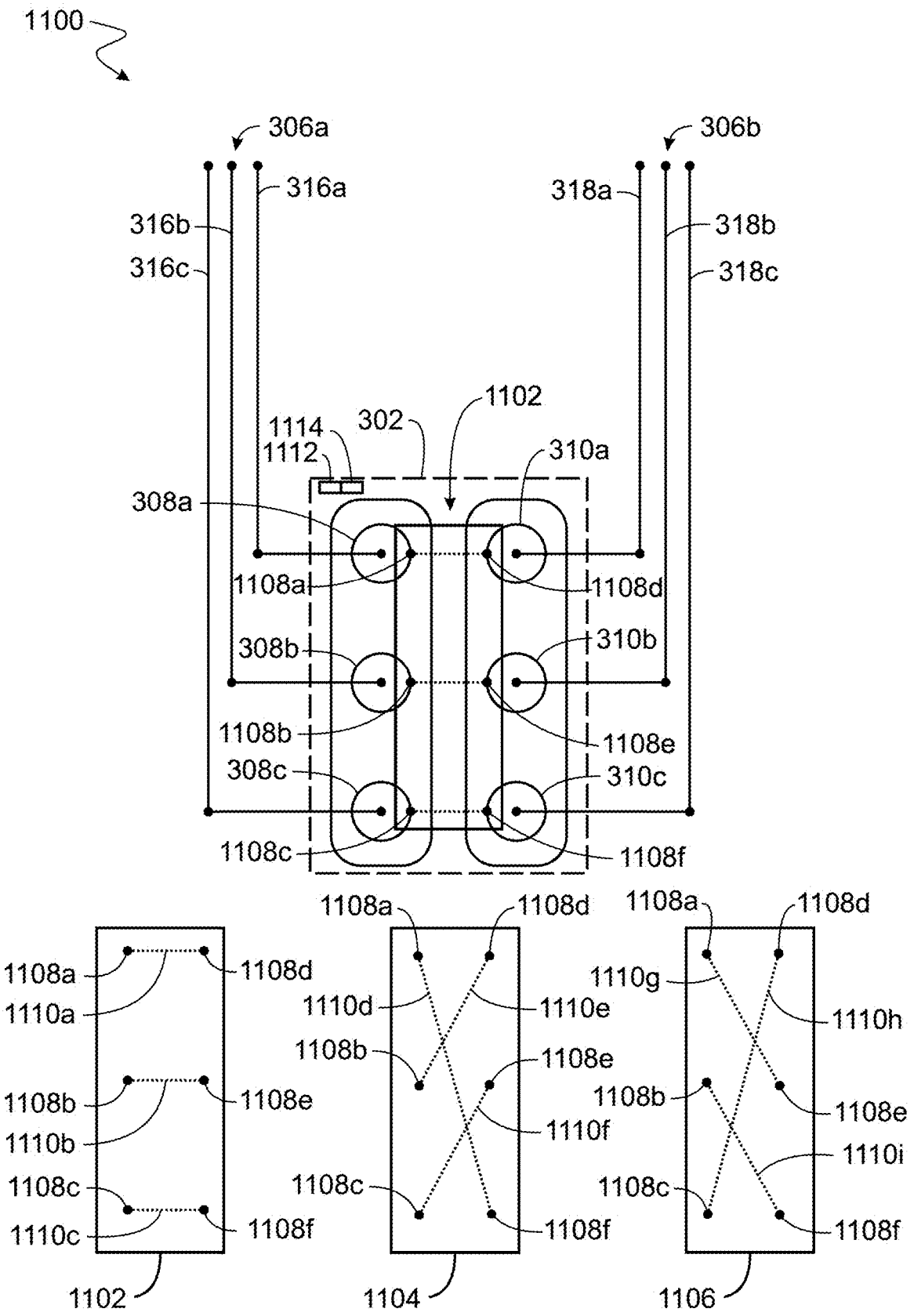
FIG. 11 shows a downhole test electrical connector selector with various test jumper configurations.

FIG. 11. shows a downhole test electrical connector selector 1100 with various test jumper configurations 1102, 1104, and 1106. FIG. 11 illustrates the downhole test electrical connector selector 1100 coupled axial docking station 302. The first test jumper configuration 1102 is illustrated as the bottom left test jumper and also shown installed in the axial docking station 302. The second test jumper configuration 1104 is shown in the bottom middle of FIG. 11. The third test jumper configuration 1106 is shown in the bottom right of FIG. 11. The downhole test electrical connector selector 1110 can be reconfigured on the surface 116 into one of the test jumper configurations 1102, 1104, and 1106, placed in the wellbore 102, and coupled to the axial docking station 302. The test jumper configurations 1102, 1104, and 1106 enable phases 316*a-c* and 318*a-c* to be joined together in various permutations, which in turn enables a greater number of measurements of conditions of the phases 316*a-c* and 318*a-c* and electrical socket connectors 308*a-c* and 310*a-c*. For example, the downhole test electrical connector selector 1100 can measure resistance, electrical insulation properties, or time domain reflectometry properties phases 316*a-c* and 318*a-c* and electrical socket connectors 308*a-c* and 310*a-c*. With a larger amount of measurements, a more accurate analysis of the location of and type of damage may be performed. Although the downhole test electrical connector selector 1110 is shown and described in reference to the axial docking station 302, in other implementations the downhole test electrical connector selector 1100 can be arranged to couple to one or more of the side pocket mandrel docking station 106 or the radial docking stations.

The downhole test electrical connector selector 1100 has multiple terminals 1108*a-f*. When the downhole test electrical connector selector 1100 is coupled to the axial docking station 302, the terminals 1108*a-f* contact the electrical socket connectors 308*a-c* and 310*a-c*, respectively.

The downhole test electrical connector selector 1100 includes multiple test jumpers 1110*a-i*. The test jumpers 1110*a-i* extend between and couple to the terminals 1108*a-f* to conduct electricity between the terminals 1108*a-f*.

In the first test jumper configuration 1102, the test jumper 1110*a* is placed to electrically couple terminal 1108*a* to terminal 1108*d*, test jumper 1110*b* is placed to electrically couple terminal 1108*b* to terminal 1108*e*, and test jumper 1110*c* is placed to electrically couple terminal 1108*c* to terminal 1108*f*. When the downhole test electrical connector selector 1100 is in the first test jumper configuration 1102 and the downhole test electrical connector selector 1100 is coupled to the axial docking station 302, the electrical socket connector 308*a* is electrically coupled to the electrical socket connector 310*a* through terminals 1108*a* and 1108*d* by test jumper 1110*a*, the electrical socket connector 308*b* is electrically coupled to the electrical socket connector 310*b* through terminals 1108*b* and 1108*e* by test jumper 1110*b*, and the electrical socket connector 308*c* is electrically coupled to the electrical socket connector 310*c* through terminals 1108*c* and 1108*f* by test jumper 1110*c*.

In the second test jumper configuration 1104, the test jumper 1110*d* is placed to electrically couple terminal 1108*a* to terminal 1108*f*, test jumper 1110*e* is placed to electrically couple terminal 1108*b* to terminal 1108*d*, and test jumper 1110*f* is placed to electrically couple terminal 1108*c* to terminal 1108*e*. When the downhole test electrical connector selector 1100 is in the second test jumper configuration 1104 and the downhole test electrical connector selector 1100 is coupled to the axial docking station 302, the electrical socket connector 308*a* is electrically coupled to the electrical socket connector 310*c* through terminals 1108*a* and 1108*f* by test jumper 1110*d*, the electrical socket connector 308*b* is electrically coupled to the electrical socket connector 310*a* through terminals 1108*b* and 1108*d* by test jumper 1110*e*, and the electrical socket connector 308*c* is electrically coupled to the electrical socket connector 310*b* through terminals 1108*c* and 1108*e* by test jumper 1110*f*.

In the third test jumper configuration 1106, the test jumper 1110*g* is placed to electrically couple terminal 1108*a* to terminal 1108*e*, test jumper 1110*h* is placed to electrically couple terminal 1108*c* to terminal 1108*d*, and test jumper 1110*i* is placed to electrically couple terminal 1108*b* to terminal 1108*f*. When the downhole test electrical connector selector 1100 is in the third test jumper configuration 1106 and the downhole test electrical connector selector 1100 is coupled to the axial docking station 302, the electrical socket connector 308*a* is electrically coupled to the electrical socket connector 310*b* through terminals 1108*a* and 1108*e* by test jumper 1110*g*, the electrical socket connector 308*b* is electrically coupled to the electrical socket connector 310*c* through terminals 1108*b* and 1108*f* by test jumper 1110*i*, and the electrical socket connector 308*c* is electrically coupled to the electrical socket connector 310*a* through terminals 1108*c* and 1108*d* by test jumper 1110*h*.

The downhole test electrical connector selector 1100 has a sensor 1112 and a controller 1114. The sensor 1112 detects a condition of a subset of the electrical connectors 308*a-c* and 310*a-c* electrically connected by the diagnostic test jumpers 1110*a-i*. For example, the subset can be one of the pairs of electrical connectors 308*a-c* and 310*a-c* selected in each of the test jumper configurations 1102, 1104, and 1106.

The sensor 1112 can include one or multiple sensors positioned throughout the completion assembly 300. In this implementation, the sensor 1112 is included in the body of the downhole test electrical connector selector 1100 and positioned in the wellbore 102 with the downhole test electrical connector selector 1100. However, in other implementations, the one or more sensors 1112 can be coupled to the electrical cables 306*a-b* within the wellbore 102 or positioned at the surface 116.

The sensor 1112 is coupled to the controller 1114. The sensor 1112 can transmit a signal representing a value of the detected condition of the electrical cables 306*a-b* and the electrical connectors 308*a-c* and 310*a-c* to the controller 1114.

The controller 1114 can include a computer with a microprocessor. The controller 1114 can have one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals from the sensor 1112 representing the condition of the electrical cables 306*a-b* and the electrical connectors 308*a-c* and 310*a-c*; comparing the signal representing the condition of the electrical cables 306*a-b* and the electrical connectors 308*a-c* and 310*a-c* to a threshold condition; and based on a result of the comparison, determining the condition of electrical cables 306*a-b* and the electrical connectors 308*a-c* and 310*a-c*.

The controller 1114 can be included in the body of the downhole test electrical connector selector 1100 and positioned in the wellbore 102 with the downhole test electrical connector selector 1100. However, in other implementations, the controller 1114 can be positioned at the surface 116.

The condition of the electrical cables 306*a-b* and the electrical connectors 308*a-c* and 310*a-c* can include a location and a type of fault of one or more failed electrical cables 306*a-b* or electrical connectors 308*a-c* and 310*a-c*. In some cases, the condition of the electrical cables 306*a-b* and the electrical connectors 308*a-c* and 310*a-c* is a condition of the insulation of the electrical cable 306*a-b*, a resistance of the electrical connectors 308*a-c* and 310*a-c*, or a time domain reflectometry condition of the electrical connectors 308*a-c* and 310*a-c*.

Figure 12:
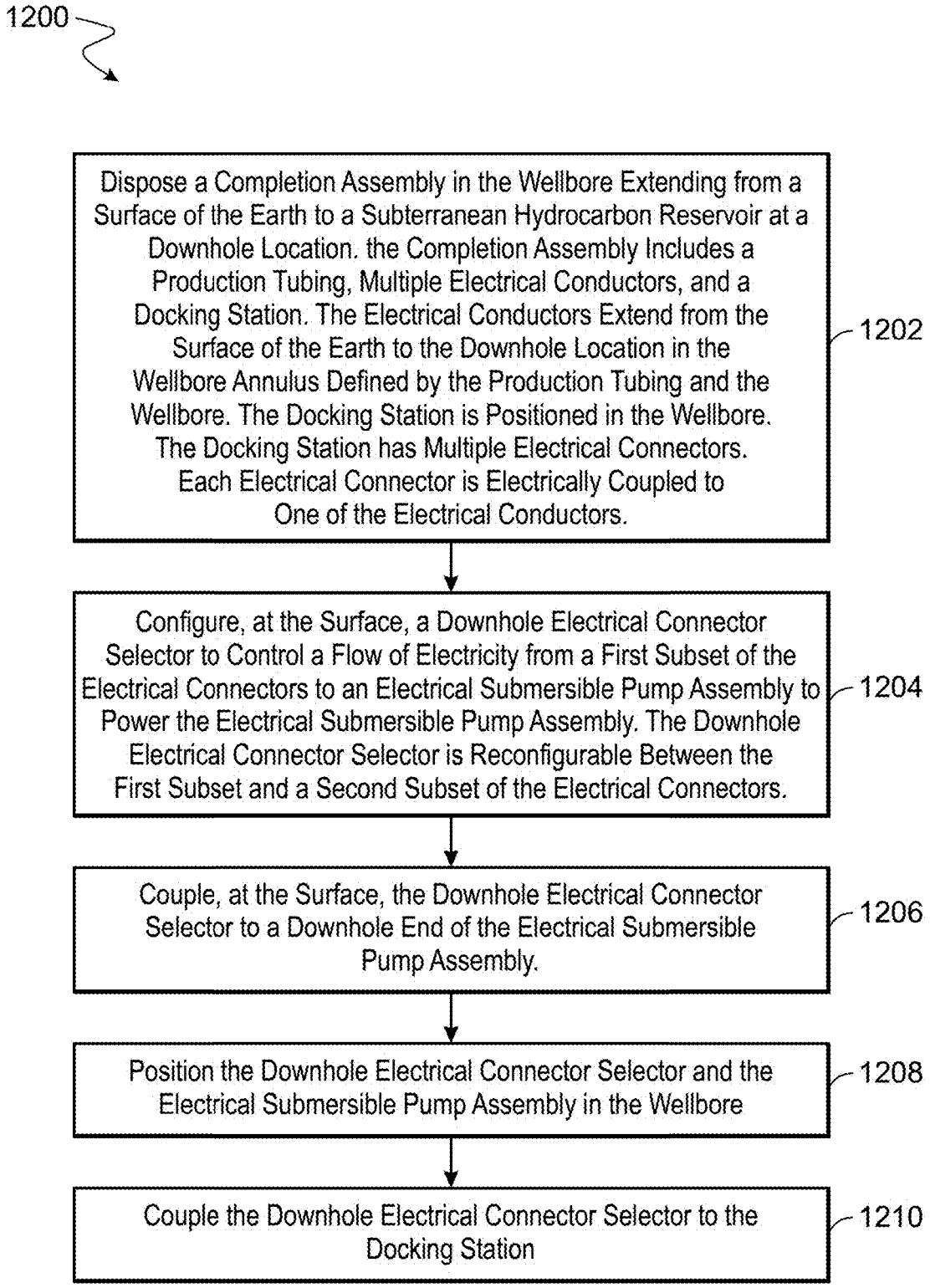
FIG. 12 is a flow chart of an example method of selectively powering an electrical submersible pump assembly.

FIG. 12 is a flow chart of an example method of selectively powering an electrical submersible pump assembly according to the implementations of the present disclosure. At 1202, a completion assembly is disposed in the wellbore. The wellbore extends from a surface of the Earth to a subterranean hydrocarbon reservoir at a downhole location. The completion assembly includes a production tubing, multiple electrical conductors, and a docking station. The electrical conductors extend from the surface of the Earth to the downhole location in the wellbore annulus. The wellbore annulus is defined by the production tubing and the wellbore. The docking station is configured to be positioned in the wellbore. The docking station has multiple electrical connectors. Each of the electrical connectors are electrically coupled to one of the electrical conductors. For example, referring to FIGS. 1-2D, the completion assembly 100 including the side pocket mandrel docking station 106 is positioned in the wellbore 102. The side pocket mandrel docking station 106 includes electrical connectors 202*a-c* and 204*a-c*. In another example, referring to FIGS. 3A-4D, the completion assembly 300 including axial docking station 302 is positioned in the wellbore 102. The axial docking station 302 includes electrical connectors 308*a-c* and 310*a-c*. Other examples include the radial docking stations, including, but not limited to the radial docking stations described in reference to FIGS. 5-10.

At 1204, a downhole electrical connector selector is configured at the surface of the Earth. The downhole electrical connector selector is configured to control a flow of electricity from a first subset of the electrical connectors to an electrical submersible pump assembly to power the electrical submersible pump assembly. The downhole electrical connector selector is reconfigurable between the first subset and a second subset of the electrical connectors. For example, the side pocket mandrel downhole electrical connector selector 104, the axial downhole electrical connector selector 304, or the radial downhole electrical connector selector 600, 700, 802 are configured or reconfigured by altering jumper locations within the respective downhole electrical connector selector. Reconfiguring the respective downhole electrical connector selector adjusts which electrical connectors of the respective docking station the respective downhole electrical connector selector is capable of receiving electricity from when the respective downhole electrical connector selector is coupled to the respective docking station.

At 1206, the downhole electrical connector selector is coupled, at the surface, to a downhole end of the electrical submersible pump assembly. For example, referring to FIG. 1, the side pocket mandrel downhole electrical connector selector 104 is coupled to the electrical submersible pump assembly 130 at the surface 116. In another example, referring to FIG. 3A, the axial downhole electrical connector selector 304 is coupled to the electrical submersible pump assembly 130 at the surface 116. Referring to FIG. 5, the radial downhole electrical connector selector 504 (i.e., selectors 600, 700, or 802) is coupled to the electrical submersible pump assembly 130 at the surface 116.

At 1208, the downhole electrical connector selector and the electrical submersible pump assembly are positioned in the wellbore. For example, referring to FIG. 1, the side pocket mandrel downhole electrical connector selector 104 and the electrical submersible pump assembly 130 are coupled to the downhole conveyance and the downhole conveyance positions the side pocket mandrel downhole electrical connector selector 104 and the electrical submersible pump assembly 130 in the wellbore 102. In another example, referring to FIG. 3A, the axial downhole electrical connector selector 304 and the electrical submersible pump assembly 130 are coupled to the downhole conveyance and the downhole conveyance positions the axial downhole electrical connector selector 304 and the electrical submersible pump assembly 130 in the wellbore 102. Referring to FIG. 5, the radial downhole electrical connector selector 504 (i.e., selectors 600, 700, or 802) and the electrical submersible pump assembly 130 are coupled to the downhole conveyance and the downhole conveyance positions the radial downhole electrical connector selector 504 (i.e., selectors 600, 700, or 802) and the electrical submersible pump assembly 130 in the wellbore 102.

At 1210, the downhole electrical connector selector is coupled to the docking station. For example, referring to FIG. 1, the side pocket mandrel downhole electrical connector selector 104 is coupled to side pocket mandrel docking station 106. In another example, referring to FIG. 3A, the axial downhole electrical connector selector 304 is coupled to axial docking station 302. Referring to FIG. 5, the radial downhole electrical connector selector 504 (i.e., selectors 600, 700, or 802) is coupled to the respective radial docking station.

In other implementations, after the downhole electrical connector selector is configured or reconfigured, the downhole electrical connector selector is positioned in the wellbore without the electrical submersible pump assembly attached. After the downhole electrical connector selector is coupled to the docking station, the electrical submersible pump assembly is positioned in the wellbore and coupled to the downhole electrical connector selector.

In some implementations, selectively powering an electrical submersible pump assembly includes based on a failure of the electrical submersible pump assembly to operate electrically, retrieving the downhole electrical connector selector and the electrical submersible pump assembly from the wellbore to the surface, determining the first subset of the electrical connectors which have failed, reconfiguring the downhole electrical connector selector to control the flow of electricity from the second subset of the electrical connectors to the electrical submersible pump assembly to power the electrical submersible pump assembly, positioning the downhole electrical connector selector and the electrical submersible pump assembly in the wellbore, and coupling the downhole electrical connector selector to the docking station.

In some implementations, selectively powering an electrical submersible pump assembly includes, after retrieving the downhole electrical connector selector and the electrical submersible pump assembly from the wellbore to the surface subsequent to determining one or more of the first subset of the electrical connectors has failed, determining a condition and a type of fault of one or more failed electrical connectors of the electrical connectors. The condition of the electrical connector can include one or more of which electrical connectors which have failed, an insulation of the electrical conductors, a resistance of each of the electrical connectors, and a time domain reflectometry condition of the electrical connectors.

In another embodiment, a test assembly includes multiple diagnostic test jumpers, a sensor, and a controller. The diagnostic test jumpers are configurable to switch between a first subset and a second subset of electrical connectors of a downhole docking station to control a flow of electricity from the docking station. The docking station is configured to couple to an electrical submersible pump assembly to maintain the flow of electricity from the docking station to the electrical submersible pump assembly. The sensor is coupled to the diagnostic test jumpers. The sensor is configured to detect a condition of the electrical connectors when a subset of the diagnostic test jumpers is coupled to the electrical connectors. The controller is coupled to the diagnostic test jumpers. The controller is configured to perform operations including receiving a signal representing the condition of the electrical connectors from the sensor; comparing the signal representing the condition of the electrical connectors to a threshold condition; and based on a result of the comparison, determining the condition of the electrical connectors. The condition of the electrical connector can include one or more of a condition of which electrical connectors have failed, an insulation of the electrical cables extending from a surface of the Earth (the electrical cables are coupled to the electrical connectors), a resistance of each of the electrical connectors, and a time domain reflectometry condition of the electrical connectors.

EMBODIMENTS

In an example aspect, a completion assembly is disposed in a wellbore to produce a hydrocarbon. The completion assembly has multiple electrical conductors, a docking station for an electrical submersible pump assembly, and a downhole electrical connector selector to couple to the docking station between the docking station and the electrical submersible pump assembly. The electrical conductors extend from a surface of the Earth to a downhole location in the wellbore. The docking station is coupled to the electrical conductors in the wellbore. The docking station has multiple electrical connectors to flow electricity from the electrical conductors to the electrical submersible pump assembly. The downhole electrical connector selector is configurable to switch between a first subset of the electrical connectors and a second subset of the electrical connectors to control a flow of electricity from the electrical connectors of the docking station to the electrical submersible pump assembly to maintain the flow of electricity to the electrical submersible pump assembly.

In an example aspect combinable with any other example aspect, the first subset of the electrical connectors and the second subset of the electrical connectors have at least one common electrical connector.

In an example aspect combinable with any other example aspect, the electrical conductors include a first three-phase electrical cable and a second three-phase electrical cable. Each phase of the first and second three-phase electrical cables is coupled to a different electrical connector.

In an example aspect combinable with any other example aspect, the electrical conductors are a partial donut-shaped flat-pack cable with between four and seven conductors. Each conductor is coupled to a different electrical connector.

In an example aspect combinable with any other example aspect, the docking station has a first side pocket and a second side pocket. The first side pocket has a first set of the electrical connectors coupled to the first three-phase electrical cable. The second side pocket is spaced apart from the first side pocket. The second side pocket has a second set of the electrical connectors coupled to the second three-phase electrical cable. The second set of the electrical connectors are different than the first set of the electrical connectors.

In an example aspect combinable with any other example aspect, the downhole electrical connector selector has a first shuttle motor connector to couple to the first side pocket and a second shuttle motor connector to couple to the second side pocket.

In an example aspect combinable with any other example aspect, each of the electrical connectors corresponding to a first phase are positioned at a first axial location along a length of the docking station, each of the electrical connectors corresponding to a second phase different than the first phase are positioned at a second axial location different than the first axial location along the length of the docking station, and each of the electrical connectors corresponding to a third phase different than the first phase and the second phase are positioned at a third axial location different than the first axial location and the second axial location along the length of the docking station.

In an example aspect combinable with any other example aspect, the electrical connectors are arranged in an axial line parallel to a longitudinal axis of the docking station.

In an example aspect combinable with any other example aspect, the electrical connectors are arranged radially arranged at the same axial location along a length of the docking station.

In an example aspect combinable with any other example aspect, the electrical connectors are arranged in three spaced apart pairs.

In an example aspect combinable with any other example aspect, the electrical connectors are arranged about a circular flow bore of the docking station.

In an example aspect combinable with any other example aspect, the electrical connectors are arranged about a bore of the docking station, the bore defining a circular cross-section.

In an example aspect combinable with any other example aspect, the electrical connectors are arranged about a bore of the docking station. The bore defines a cross section having an inner circular cross-section and multiple outer circular cross-sections extending from the inner circular cross-section. Each pair of the three spaced apart pairs are separated by at least one of the outer circular cross-sections.

In an example aspect combinable with any other example aspect, the completion assembly further includes a downhole test electrical connector selector configurable to couple to the electrical connectors. The downhole test electrical connector selector has multiple diagnostic test jumpers, a sensor, and a controller. The diagnostic test jumpers electrically couple to a subset of the electrical connectors. The sensor detects a condition of the subset of the electrical connectors electrically connected by the diagnostic test jumpers. The controller is coupled to the sensor. The controller performs operations including receiving, from the sensor, a signal representing the condition of the electrical connectors; comparing the signal representing the condition of the electrical connectors to a threshold condition; and based on a result of the comparison, determining the condition of the electrical connectors.

In an example aspect combinable with any other example aspect, the condition of the electrical connectors includes a location and a type of fault of one or more failed electrical connectors of the electrical connectors.

In an example aspect combinable with any other example aspect, the condition of the electrical connectors includes one or more of a condition of an insulation of the electrical conductor, a resistance of the electrical connectors, or a time domain reflectometry condition of the electrical connectors.

In another example aspect, a method for completing a wellbore includes disposing a completion assembly in the wellbore extending from a surface of the Earth to a subterranean hydrocarbon reservoir at a downhole location. The completion assembly includes a production tubing, multiple electrical conductors, and a docking station. The electrical conductors extend from the surface of the Earth to the downhole location in a wellbore annulus defined by the production tubing and the wellbore. The docking station is positioned in the wellbore and has multiple electrical connectors. Each electrical connector is electrically coupled to one of the electrical conductors. The method includes configuring, at the surface, a downhole electrical connector selector to control a flow of electricity from a first subset of the electrical connectors to an electrical submersible pump assembly to power the electrical submersible pump assembly. The downhole electrical connector selector is reconfigurable between the first subset and a second subset of the electrical connectors. The method includes coupling, at the surface, the downhole electrical connector selector to a downhole end of the electrical submersible pump assembly. The method includes positioning the downhole electrical connector selector and the electrical submersible pump assembly in the wellbore. The method includes coupling the downhole electrical connector selector to the docking station.

In an example aspect combinable with any other example aspect, the method includes, based on a failure of the electrical submersible pump assembly to operate electrically, retrieving the downhole electrical connector selector and the electrical submersible pump assembly from the wellbore to the surface; determining the first subset of the electrical connectors has failed; reconfiguring the downhole electrical connector selector to control the flow of electricity from the second subset of the electrical connectors to the electrical submersible pump assembly to power the electrical submersible pump assembly; positioning the downhole electrical connector selector and the electrical submersible pump assembly in the wellbore; and coupling the downhole electrical connector selector to the docking station.

In an example aspect combinable with any other example aspect, after retrieving the downhole electrical connector selector and the electrical submersible pump assembly from the wellbore to the surface subsequent to determining one or more of the first subset of the electrical connectors has failed, the method further includes determining a condition and a type of fault of one or more failed electrical connectors of the electrical connectors. The condition of the electrical connector includes one or more of which electrical connectors have failed, an insulation of the electrical conductors, a resistance of each of the electrical connectors, and a time domain reflectometry condition of the electrical connectors.

In another example, at test assembly includes multiple diagnostic test jumpers, a sensor, and a controller. The diagnostic test jumpers are configurable to switch between a first subset and a second subset of electrical connectors to control a flow of electricity from a docking station to couple to an electrical submersible pump assembly to maintain the flow of electricity from the docking station to the electrical submersible pump assembly. The sensor is coupled to the diagnostic test jumpers. The sensor detects a condition of the electrical connectors when a subset of the diagnostic test jumpers are coupled to the electrical connectors. The controller is coupled to the diagnostic test jumpers. The controller performs operations including receiving, from the sensor, a signal representing the condition of the electrical connectors; comparing the signal representing the condition of the electrical connectors to a threshold condition; and based on a result of the comparison, determining the condition of the electrical connectors. The condition of the electrical connector includes one or more of a condition of which electrical connectors have failed, an insulation of the electrical conductors configured to extend from a surface of the Earth where the electrical conductors are coupled to the electrical connectors, a resistance of each of the electrical connectors, and a time domain reflectometry condition of the electrical connectors.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A completion assembly configured to be disposed in a wellbore to produce a hydrocarbon, the completion assembly comprising:

a plurality of electrical conductors extending from a surface of the Earth to a downhole location in the wellbore, the plurality of electrical conductors comprising a first three-phase electrical cable and a second three-phase electrical cable;

a docking station for an electrical submersible pump assembly, the docking station coupled to the plurality of electrical conductors in the wellbore, the docking station comprising a plurality of electrical connectors configured to flow electricity from the plurality of electrical conductors to the electrical submersible pump assembly, each phase of the first and second three-phase electrical cables coupled to a different electrical connector, wherein the docking station comprises a first side pocket comprising a first set of the plurality of the electrical connectors coupled to the first three-phase electrical cable and a second side pocket spaced apart from the first side pocket, the second side pocket comprising a second set of the plurality of the electrical connectors coupled to the second three-phase electrical cable, the second set of the plurality of the electrical connectors different than the first set of the plurality of the electrical connectors; and a downhole electrical connector selector configured to couple to the docking station between the docking station and the electrical submersible pump assembly, the downhole electrical connector selector configurable to switch between a first subset of the plurality of electrical connectors and a second subset of the plurality of electrical connectors to control a flow of electricity from the plurality of electrical connectors of the docking station to the electrical submersible pump assembly to maintain the flow of electricity to the electrical submersible pump assembly.

2. The completion assembly of claim 1, wherein the first subset of the plurality of electrical connectors and the second subset of the plurality of electrical connectors comprise at least one common electrical connector.

3. The completion assembly of claim 1, wherein the plurality of electrical conductors comprises a partial donut-shaped flat-pack cable comprising between four and seven conductors, each conductor coupled to a different electrical connector.

4. The completion assembly of claim 1, wherein the downhole electrical connector selector comprises a first shuttle motor connector configured to couple to the first side pocket and a second shuttle motor connector configured to couple to the second side pocket.

5. The completion assembly of claim 1, wherein each of the electrical connectors corresponding to a first phase are positioned at a first axial location along a length of the docking station, each of the electrical connectors corresponding to a second phase different than the first phase are positioned at a second axial location different than the first axial location along the length of the docking station, and each of the electrical connectors corresponding to a third phase different than the first phase and the second phase are positioned at a third axial location different than the first axial location and the second axial location along the length of the docking station.

6. The completion assembly of claim 1, wherein the electrical connectors are arranged in an axial line parallel to a longitudinal axis of the docking station.

7. The completion assembly of claim 1, wherein the electrical connectors are arranged radially at the same axial location along a length of the docking station.

8. The completion assembly of claim 7, wherein the electrical connectors are arranged in three spaced apart pairs.

9. The completion assembly of claim 8, wherein the electrical connectors are arranged about a circular flow bore of the docking station.

10. The completion assembly of claim 8, wherein the electrical connectors are arranged about a bore of the docking station, the bore defining a circular cross-section.

11. The completion assembly of claim 8, wherein the electrical connectors are arranged about a bore of the docking station, the bore defining a cross section comprising:

an inner circular cross-section; and a plurality of outer circular cross-sections extending from the inner circular cross-section, wherein each pair of the three spaced apart pairs are separated by at least one of the outer circular cross-sections.

12. The completion assembly of claim 8, further comprising a downhole test electrical connector selector configurable to couple to the plurality of electrical connectors, the downhole test electrical connector selector comprising:

a plurality of diagnostic test jumpers configured to electrically couple to a subset of the plurality of electrical connectors;

a sensor configured to detect a condition of the subset of the plurality of electrical connectors electrically connected by the plurality of diagnostic test jumpers; and a controller coupled to the sensor, the controller configured to perform operations comprising:

receiving, from the sensor, a signal representing the condition of the plurality of electrical connectors;

comparing the signal representing the condition of the plurality of electrical connectors to a threshold condition; and based on a result of the comparison, determining the condition of the plurality of electrical connectors.

13. The completion assembly of claim 12, wherein the condition of the plurality of electrical connectors comprises a location and a type of fault of one or more failed electrical connectors of the plurality of electrical connectors.

14. The completion assembly of claim 13, wherein the condition of the electrical connectors comprises one or more of a condition of an insulation of the electrical conductor, a resistance of the electrical connectors, or a time domain reflectometry condition of the electrical connectors.

15. A method for completing a wellbore, the method comprising:

disposing a completion assembly in the wellbore extending from a surface of the Earth to a subterranean hydrocarbon reservoir at a downhole location, the completion assembly comprising:

a production tubing;

a plurality of electrical conductors extending from the surface of the Earth to the downhole location in a wellbore annulus defined by the production tubing and the wellbore; and a docking station configured to be positioned in the wellbore, the docking station comprising a plurality of electrical connectors, each electrical connector of the plurality of electrical connectors electrically coupled to one of the plurality of electrical conductors;

configuring, at the surface, a downhole electrical connector selector to control a flow of electricity from a first subset of the plurality of electrical connectors to an electrical submersible pump assembly to power the electrical submersible pump assembly, the downhole electrical connector selector reconfigurable between the first subset and a second subset of the plurality of electrical connectors;

coupling, at the surface, the downhole electrical connector selector to a downhole end of the electrical submersible pump assembly;

positioning the downhole electrical connector selector and the electrical submersible pump assembly in the wellbore;

coupling the downhole electrical connector selector to the docking station, based on a failure of the electrical submersible pump assembly to operate electrically, retrieving the downhole electrical connector selector and the electrical submersible pump assembly from the wellbore to the surface;

determining the first subset of the plurality of electrical connectors has failed;

reconfiguring the downhole electrical connector selector to control the flow of electricity from the second subset of the plurality of the electrical connectors to the electrical submersible pump assembly to power the electrical submersible pump assembly;

positioning the downhole electrical connector selector and the electrical submersible pump assembly in the wellbore; and coupling the downhole electrical connector selector to the docking station.

16. The method of claim 15, after retrieving the downhole electrical connector selector and the electrical submersible pump assembly from the wellbore to the surface subsequent to determining one or more of the first subset of the plurality of electrical connectors has failed, the method further comprises determining a condition and a type of fault of one or more failed electrical connectors of the plurality of electrical connectors, wherein the condition of the electrical connector comprises one or more of which electrical connectors have failed, an insulation of the plurality of electrical conductors, a resistance of each of the electrical connectors, and a time domain reflectometry condition of the electrical connectors.

17. A test assembly comprising:

a plurality of diagnostic test jumpers configurable to switch between a first subset and a second subset of a plurality of electrical connectors to control a flow of electricity from a docking station configured to couple to an electrical submersible pump assembly to maintain the flow of electricity from the docking station to the electrical submersible pump assembly;

a sensor coupled to the plurality of diagnostic test jumpers, the sensor configured to detect a condition of the plurality of electrical connectors when a subset of the plurality of diagnostic test jumpers are coupled to the plurality of electrical connectors; and a controller coupled to the plurality of diagnostic test jumpers, the controller configured to perform operations comprising:

receiving, from the sensor, a signal representing the condition of the plurality of electrical connectors;

comparing the signal representing the condition of the plurality of electrical connectors to a threshold condition; and based on a result of the comparison, determining the condition of the plurality of electrical connectors, the condition of the electrical connector comprises one or more of a condition of which electrical connectors have failed, an insulation of a plurality of electrical conductors configured to extend from a surface of the Earth, the plurality of electrical conductors coupled to the plurality of electrical connectors, a resistance of each of the electrical connectors, and a time domain reflectometry condition of the electrical connectors.

* * * * *